US011737624B2

(12) United States Patent
Yang et al.

(10) Patent No.: US 11,737,624 B2
(45) Date of Patent: Aug. 29, 2023

(54) SUCTION CLEANER HAVING A CLEANING BODY

(71) Applicant: LG ELECTRONICS INC., Seoul (KR)

(72) Inventors: In Gyu Yang, Seoul (KR); Jin Hyouk Shin, Seoul (KR); Dae Ho Chang, Seoul (KR); Kyoung Ho Ryou, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 159 days.

(21) Appl. No.: 17/023,877

(22) Filed: Sep. 17, 2020

(65) Prior Publication Data

US 2021/0093140 A1 Apr. 1, 2021

(30) Foreign Application Priority Data

Sep. 30, 2019 (KR) ..... 10-2019-0121054

(51) Int. Cl.
*A47L 9/10* (2006.01)
*A47L 5/24* (2006.01)
(Continued)

(52) U.S. Cl.
CPC ..... *A47L 9/108* (2013.01); *A47L 5/24* (2013.01); *A47L 9/127* (2013.01); *A47L 9/1616* (2013.01); *A47L 9/1683* (2013.01)

(58) Field of Classification Search
CPC ..... A47L 9/108; A47L 9/127; A47L 9/1616; A47L 9/1683; A47L 5/24
(Continued)

(56) References Cited

U.S. PATENT DOCUMENTS 6,625,845 B2 * 9/2003 Matsumoto ..... A47L 9/20 15/352
6,968,596 B2 * 11/2005 Oh ..... A47L 9/104 55/505
(Continued)

FOREIGN PATENT DOCUMENTS

| | | |
|---|---|---|
| JP | 3699679 B2 | 9/2005 |
| KR | 10-1856504 | 5/2018 |
| KR | 10-2021922 | 9/2019 |

OTHER PUBLICATIONS

European Search Report and Communication issued in Application No. 20196575.3 dated Mar. 5, 2021 (8 pages).
(Continued)

*Primary Examiner* — Don M Anderson
*Assistant Examiner* — Jonathan R Zaworski
(74) *Attorney, Agent, or Firm* — Birch, Stewart, Kolasch & Birch, LLP

(57) ABSTRACT

A cleaner is disclosed. The cleaner includes: a housing having an introduction opening through which air is introduced; a filtering unit configured to be mounted in an inner space of the housing, and defining a dust collection space between the filtering unit and an inner surface of the housing; and a cleaning unit surrounding the filtering unit and configured to be raised and lowered. When the cleaning unit is in an initial position at least a portion of the cleaning unit is connected to an air introduction path extending from the introduction opening such that the cleaning unit guides a flow of introduced air. A guide edge extends from a lower portion of the cleaning unit toward a bottom of the dust collection space, and a surface of the guide edge facing the inner surface of the housing is inclined.

18 Claims, 24 Drawing Sheets

(51) Int. Cl.
*A47L 9/12* (2006.01)
*A47L 9/16* (2006.01)

(58) Field of Classification Search
USPC ..... 15/347
See application file for complete search history.

(56) References Cited

U.S. PATENT DOCUMENTS

| | | | | |
|---|---|---|---|---|
| 8,549,704 | B2 * | 10/2013 | Milligan | A47L 9/2805 15/327.2 |
| 9,107,551 | B2 * | 8/2015 | Kwon | A47L 5/365 |
| 10,485,393 | B2 * | 11/2019 | Muir | A47L 9/242 |
| 11,064,855 | B2 * | 7/2021 | Hwang | A47L 9/2857 |
| 11,116,373 | B2 * | 9/2021 | Hyun | A47L 9/108 |
| 2004/0025285 | A1 * | 2/2004 | McCormick | A47L 9/19 15/352 |
| 2018/0132685 | A1 * | 5/2018 | Muir | A47L 9/149 |
| 2018/0132686 | A1 | 5/2018 | Muir et al. | |
| 2019/0183301 | A1 * | 6/2019 | Hwang | A47L 9/165 |
| 2019/0254494 | A1 * | 8/2019 | Hyun | A47L 9/1608 |
| 2019/0274503 | A1 * | 9/2019 | Hyun | A47L 9/1683 |

OTHER PUBLICATIONS

Office Action of Korean Application No. 10-2019-0121054 dated Dec. 1, 2020.

* cited by examiner

SUCTION CLEANER HAVING A CLEANING BODY

CROSS REFERENCE TO RELATED APPLICATION

The present application claims priority to Korean Patent Application No. 10-2019-0121054, filed Sep. 30, 2019, the entire contents of which is incorporated herein for all purposes by this reference.

TECHNICAL FIELD

The present disclosure generally relates to a cleaner. More particularly, the present disclosure relates to a cleaner which has a cleaning unit capable of compressing dust accumulated inside a dust container without opening the dust container.

BACKGROUND

A cleaner is a device that performs cleaning by suctioning or scraping off dust or foreign matter in the area to be cleaned. Such cleaners may include manual cleaners, which may perform a cleaning while being directly moved by a user, and automatic cleaners, which may move automatically to perform a cleaning.

In addition, a manual cleaner may be classified into a canister cleaner, an upright cleaner, a handheld cleaner, and a stick cleaner depending on the type of a cleaner. A handheld cleaner includes a separating device that separates waste and dust from an air stream.

The separating device includes a centrifuge that generates one or more cyclones. The centrifuge includes a first cyclone provided with a dust collector having a wall. The dust collector is arranged at a lower side of the first cyclone, and the dust collector may be opened and closed by a base thereof (a lower cover). The base may be rotated on a hinge and may allow the dust collector to be opened and closed.

A filter part having multiple through holes and forming a sort of cover may be provided inside the first cyclone. A second cyclone may communicate with the first cyclone through the filter part. Air inside the first cyclone may pass through the filter part, and then flow to the second cyclone. In this case, while the air passes through the through holes of the filter part, dust contained in the air may block the through holes of the filter part. As the blocking of the through holes increases, the air may not efficiently flow, and the performance of the cleaner may deteriorate.

Accordingly, a user is required to periodically clean the filter part. To this end, the user is required to open the dust collector by rotating the base, which is the lower cover, to reach the filter part in order to clean the filter part. Accordingly, it may not be easy for the user to clean the filter part.

In addition, in the prior art, dust separated from the air stream in the first cyclone and the second cyclone falls downward, and accumulates at the upper side of the base. When the cleaner stops working, the separated dust is stored in a low density state in the dust collector. That is, the dust separated by the first cyclone occupies large volume compared to weight thereof. Accordingly, although there is still sufficient free space inside the dust collector, the dust in a dust container must be emptied frequently to maintain dust collection performance thereof.

To solve this, technologies in which a compression member (a cleaning part) that can compress dust accumulated in a dust collection part is mounted inside the dust collection part, and the dust is compressed by lowering the compression member from the outside without opening the base are disclosed in Japanese Patent No. 3699679 and US Patent Application Publication No. 2018-0132685. The compression member is mounted to surround the filter part, can scrape off dust on the filter part while moving toward the base, and can compress dust accumulated in the dust collection part.

However, the compression member disclosed in such prior art may prevent air from being introduced into the dust collection part. This is because the compression member located at an initial position surrounding the upper portion of the filter part before compressing dust is close to an air introduction opening through which air is introduced. Of course, the introduction opening may be provided in the compression member, but in this case, the compression member may make the introduction opening narrow, so air and dust contained in the air may be prevented from being introduced thereto.

Particularly, when the size of foreign matter, such as dust, is large, the introduction opening may be easily blocked by the foreign matter. When large foreign matter is introduced through the introduction opening of the cleaner, the foreign matter may be held between the outer surface of the compression member and the inner surface of the dust collection part. In this case, since air inflow may not be efficiently performed, the performance of the cleaner may be greatly deteriorated.

In addition, when flat foreign matter is introduced to the introduction opening in vertical orientation (where the height is larger in size than width), the foreign matter can pass through the introduction opening, which is narrow in width. However, when the foreign matter is introduced to the introduction opening with strong force in horizontal orientation (where the width is larger in size than height), the foreign matter may collide with the compression member, and may then be bounced toward the inner surface of the dust collection part by a reaction force to the collision, so the foreign matter may be held therebetween. This may cause the foreign matter to block the introduction opening.

Of course, the compression member may be mounted such that the initial position of the compression member is away from the introduction opening of air. In this case, more space to secure the initial position of the compression member is required, thereby increasing the entire height and volume of the cleaner.

In addition, the compression member has a ring shape and surrounds the filter part. When the compression member is off center while raising and lowering, the compression member may interfere with the filter part, thereby preventing the efficient raising and lowering of the compression member. Particularly, since the compression member surrounds the entirety of the filter part, a portion far away from a portion in which the compression member is connected to a manipulation part may easily become off-center.

Furthermore, the conventional compression member is connected to a manipulation lever protruding from the outer part of a cleaner such that the compression member is manipulated at the outer part. In the process of manipulating the manipulation lever, a large load is focused on a connection part connecting the manipulation lever to the compression member and the surrounding portion thereof, so the compression member may be easily deformed or damaged. When the surrounding portion of the connection part of the compression member is deformed, the surrounding portion interferes with components inside the cleaner, which may interrupt the efficient raising and lowering of the compression member.

Additionally, a portion of the end portion of the conventional compression member may be made of an elastic material such that the friction of the compression member with the outer surface of the filter part is reduced and more efficient cleaning is performed. In the manufacturing process of attaching the end portion of the elastic material to the compression member, or in the process of the raising and lowering of the compression member, the end portion may be curled or turned over.

SUMMARY

Accordingly, keeping in mind the above problems occurring in the related art, the present disclosure provides a cleaner having a cleaning unit securing free space by compressing dust accumulated inside a dust container of the cleaner without preventing the introduction of air and foreign matter into the dust container.

In addition, the present disclosure provides a cleaner, wherein in the process in which the cleaning unit is raising and lowering while surrounding a filtering unit, a constant gap between the cleaning unit and the filtering unit may be maintained so that the cleaning unit is not eccentric and not interfered with by the filtering unit.

Furthermore, the present disclosure provides a cleaner, wherein the strength of a connection part connecting the cleaning unit and a manipulation unit located at the outside thereof to each other is increased by reinforcement so that the cleaning unit is not easily deformed.

Additionally, the present disclosure provides a cleaner, wherein a cleaning ring made of an elastic material may be provided at the end of the cleaning unit, and in the process of the attaching of the cleaning ring thereto or in the process of the raising and lowering of the cleaning unit, the cleaning ring is prevented from curling upward.

In order to achieve the above objectives, according to one aspect of the present disclosure, a cleaner may be provided including: a cleaning unit provided inside a housing, the cleaning unit raising and lowering while surrounding a filtering unit. At least a portion of the cleaning unit at an initial position may communicate with an air introduction path extending from an introduction opening of the housing such that the flow of the introduced air is guided. A guide edge may extend from the lower portion of the cleaning unit toward the bottom of a dust collection space. In this case, the surface of the guide edge facing the inner surface of the housing may be inclined to gradually increase the gap between the surface of the guide edge and the inner surface of the housing at the same height in a direction toward an end portion of the guide edge that is directed toward the bottom of the dust collection space.

Accordingly, in the present disclosure, even without opening a dust container, the cleaning unit may compress dust collected in the dust container while moving (lowering) inside the dust collection space. The surface of the cleaning unit may extend in an inclining direction to the moving direction of the cleaning unit, whereby the size of the introduction opening of air may be sufficiently secured, and introduced foreign matter may be naturally induced in the direction of the dust container located at the lower side of the cleaning unit by hitting the inclining surface of the cleaning unit.

In addition, the guide edge of the cleaning unit of the present disclosure may be spaced apart from the surface of the filtering unit to define a space therebetween. A support rib provided in the cleaning unit may protrude in a direction of reducing the space. Particularly, a gap maintenance rib may protrude from the support rib and maintain a constant gap between the cleaning unit and the filtering unit. Due to such gap maintenance, in the process of the raising and lowering of the cleaning unit, the cleaning unit may be prevented from being eccentric and interfered with by the filtering unit, and the efficient raising and lowering of the cleaning unit may be performed.

In addition, the support rib may protrude from the lower portion of the cleaning body constituting the cleaning unit toward the bottom of the dust collection space, and may support the opposite surface of a guide inclination surface of a cleaning ring. Such a support rib may prevent the cleaning ring from being deformed due to high temperature in the process of the double injection of the cleaning ring, or may prevent the cleaning ring from being curled in the process of raising and lowering the cleaning unit.

In addition, the lower surface of a coupling end part located at the lower end of a guide wall of the cleaning body may be coupled to the upper surface of the cleaning ring; the front surface of the cleaning ring may face the inner surface of the housing; and the rear surface of the cleaning ring may face the surface of the filtering unit at the lowering position of the cleaning unit. That is, since the support rib stably supports the cleaning ring at the rear side thereof, the portion of surrounding and fixing the outer surface of the cleaning ring in the cleaning unit may be minimized, and the exposed portion of the outer surface of the cleaning ring may be increased, so that the amount of elastic transformation of the cleaning ring may be increased, whereby efficient cleaning of the cleaner may be performed, and an inclining surface allowing introduced foreign matter to be bounced downward may be sufficiently formed on the surface of the cleaning ring.

In addition, a connecting plate may extend from the cleaning body of the cleaning unit in the raising/lowering direction of the cleaning unit. The connecting plate may be connected to a manipulation unit so that the manipulation unit and the cleaning unit may operate in cooperation with each other. Accordingly, in the present disclosure, the connecting plate (also, referred to as a connection part) connecting the manipulation unit with the cleaning unit may be secured to be sufficiently wide along the raising/lowering direction of the cleaning unit. Accordingly, the connection part on which an external force (a force of raising and lowering the cleaning unit) transmitted from the manipulation unit is focused may be reinforced.

In addition, a reinforcement plate may be coupled to the connecting plate, and a connection bracket may be provided in the reinforcement plate and may be connected to the manipulation unit. That is, the connecting plate may be formed to be sufficiently large in the cleaning unit of the present disclosure, and the reinforcement plate may be correspondingly coupled to the connecting plate. Accordingly, the strength of the connection between the cleaning unit and the manipulation unit may be reinforced and the connection may be more secure.

In addition, an upper cleaning part may be provided on the upper surface of the cleaning body corresponding to a side opposite to the guide flow path formed by the cleaning unit, the upper cleaning part being formed as a continuous path along a circumferential direction of the cleaning body. An entrance of the upper cleaning part starting at a position adjacent to the introduction opening may be formed at a location higher than an exit of the upper cleaning part. Accordingly, since the height of the upper cleaning part gradually decreases from the entrance toward the exit, dust may be naturally removed by air flowing in the upper cleaning part although dust is accumulated on the upper surface of the cleaning unit.

The cleaner of the present disclosure described above has the following effects.

First, according to the present disclosure, even without opening the dust container, the cleaning unit can compress dust collected in the dust container while moving (lowering) inside the dust collection space. The surface of the cleaning unit may extend in an inclining direction to the moving direction thereof, so the size of the introduction opening of air can be sufficiently secured. Furthermore, introduced foreign matter can be naturally induced in the direction of the dust container located at the lower side of the cleaning unit by hitting the inclining surface of the cleaning unit. Accordingly, large foreign matter can be prevented from blocking the introduction opening by being held therein, and the high operation performance of the cleaner can be maintained, thereby improving the operation reliability of the cleaner.

In addition, the cleaning unit of the present disclosure can scrape off dust from the surface of the filtering unit while raising and lowering by surrounding the filtering unit. The gap maintenance rib may protrude from the cleaning unit to maintain a constant gap between the cleaning unit and the filtering unit. Due to maintenance of such a gap, the cleaning unit can be prevented from being interfered with by the filtering unit by being eccentric while raising and lowering, and the efficient raising and lowering of the cleaning unit can be performed. Accordingly, compression of the dust performed by the cleaning unit and the cleaning of the filtering unit can be more stably performed.

Furthermore, the cleaning ring, which may be made of an elastic material, may be provided in the cleaning unit of the present disclosure, and the rear surface of the cleaning ring may be supported by the support rib. Such a support rib can prevent the cleaning ring from being deformed due to high temperature in the process of the double injection of the cleaning ring, and can prevent the cleaning ring from being curled during the raising and lowering of the cleaning unit, thereby improving the quality and reliability of the cleaning unit.

Particularly, since the support rib supports the cleaning ring at the rear side thereof, the portion of the cleaning unit surrounding the cleaning ring and fixing the outer surface of the cleaning ring in the cleaning unit can be minimized and the exposed portion of the outer surface of the cleaning ring can be increased. Accordingly, the amount of elastic transformation of the cleaning ring can be increased, thereby enabling efficient cleaning of the cleaner, and sufficiently forming the inclining surface allowing introduced foreign matter to be bounced downward on the surface of the cleaning ring.

In addition, the manipulation unit may be connected to the cleaning unit to raise and lower the cleaning unit. In the present disclosure, the connecting plate securing the manipulation unit may be sufficiently wide along the raising/lowering direction of the cleaning unit. Accordingly, the connection part on which an external force (a force of raising and lowering the cleaning unit) transmitted from the manipulation unit is focused can be reinforced, and thus can be prevented from being warped or damaged, thereby improving durability of the connection part.

Furthermore, the connecting plate may be formed to be sufficiently large in the cleaning unit of the present disclosure, and the reinforcement plate may be correspondingly coupled to the connecting plate. Accordingly, the strength of the connection part connecting the cleaning unit and the manipulation unit to each other can be reinforced.

In addition, in the present disclosure, the upper cleaning part may be provided on the upper surface of the cleaning unit, the upper cleaning part forming a continuous path along the circumferential direction of the cleaning unit. The height of the upper cleaning part may gradually decrease from the entrance thereof toward the exit thereof. Accordingly, the exit of the upper cleaning part may be lower than the entrance of the upper cleaning part. Accordingly, although dust is accumulated on the upper surface of the cleaning unit, the dust can be efficiently removed therefrom by air flowing in the upper cleaning part. Accordingly, although a user does not clean the upper surface of the cleaning unit, this may prevent the cleaning unit from failing to be restored to the initial position due to dust accumulated on the upper surface of the cleaning unit.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION

Figure 1:
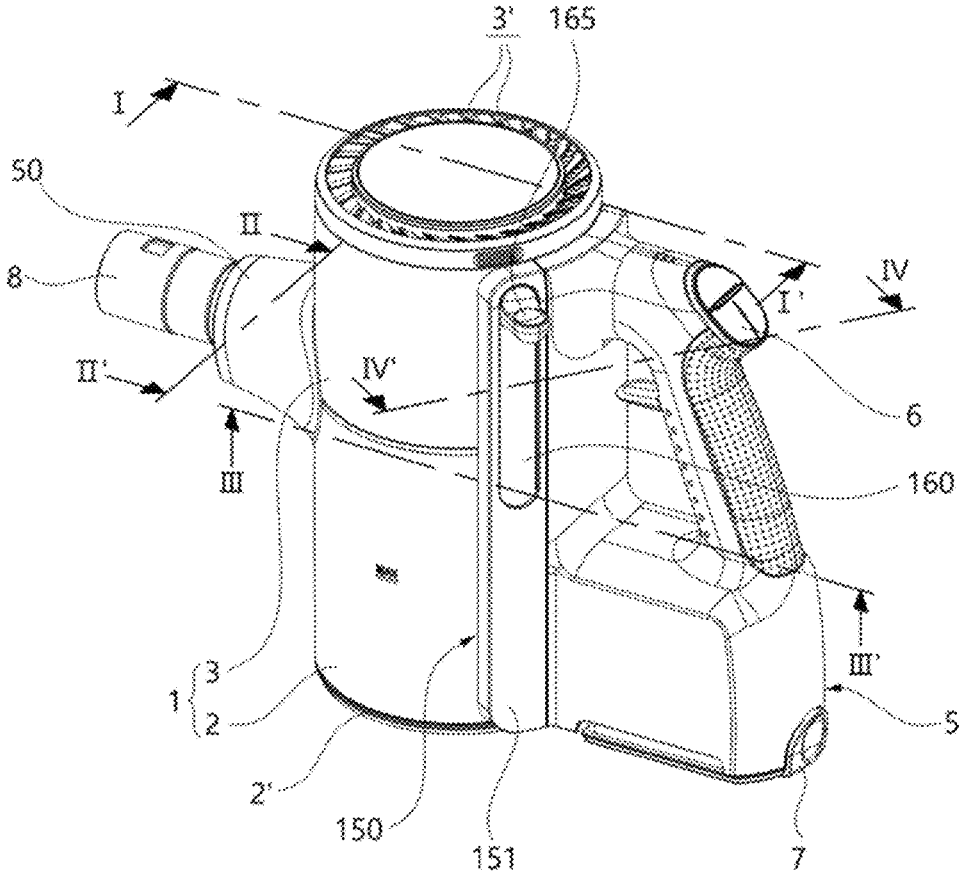
FIG. 1 is a perspective view illustrating an example configuration of a cleaner according an embodiment of the present disclosure.

Hereinafter, some embodiments of the present disclosure will be described in detail with reference to the accompanying drawings. It should be noted that in adding reference numerals to the components of each drawing, the same components have the same reference numerals when possible, even if they are displayed on different drawings. In addition, in describing the embodiments of the present disclosure, when it is determined that a detailed description of a related known configuration or function interferes with the understanding of the present disclosure, the detailed description is to be omitted.

In addition, in describing the components of the embodiments of the present disclosure, terms such as first, second, A, B, a, and b may be used. These terms are only for distinguishing the components from other components, and the nature or order of the components is not limited by the terms. When a component is described as being "connected" or "coupled" to another component, that component may be directly connected to or coupled to the another component. However, it should be understood that another component may be "connected" or "coupled" to each component therebetween.

The present disclosure relates to a cleaner, and more particularly, relates to a cleaner which separates dust from air by using a cyclone flow of air. Particularly, the cleaner of the present disclosure may include a cleaning unit 110 capable of compressing dust accumulated inside the dust container by using a manipulation lever at the outside of the of a housing without opening an entrance of a dust container. Hereinafter, the present disclosure is described to be applied to a handheld vacuum cleaner as an example, but may be applied to other types of cleaners such as a canister cleaner.

Figure 2:
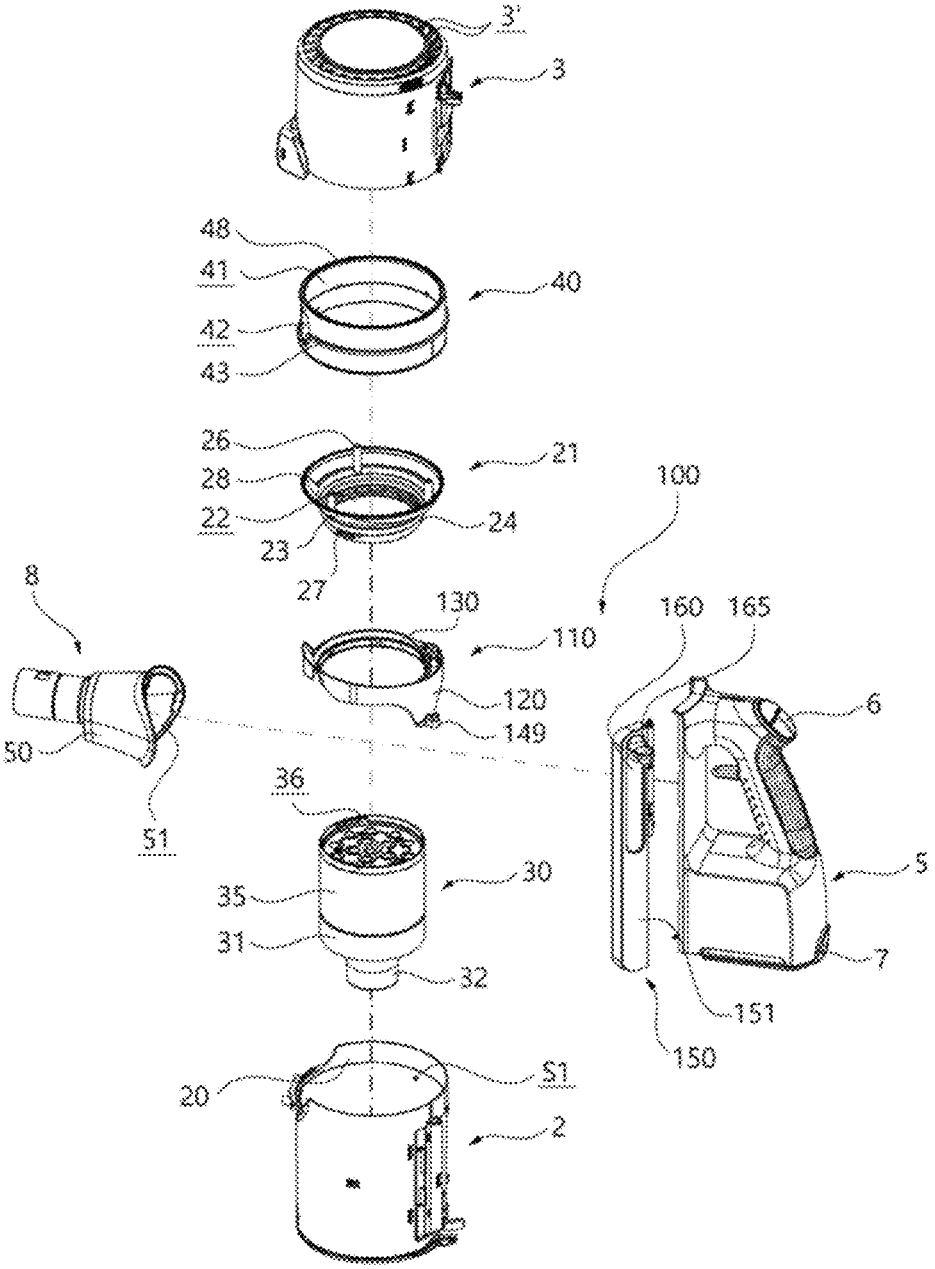
FIG. 2 is an exploded perspective view of components constituting the cleaner of FIG. 1.

FIG. 1 is a perspective view illustrating the configuration of the cleaner according an embodiment of the present disclosure, and FIG. 2 is an exploded perspective view of components constituting the cleaner. As illustrated in these drawings, first, the housing 1 may constitute the appearance and frame of the cleaner of the present disclosure. In some embodiments, the housing 1 may be mainly divided into a first housing 2 and a second housing 3, and may have an approximately cylindrical shape. Here, the first housing 2 may constitute the dust container. When a lower cover 2' located at a lower side of the dust container is opened, the dust container may be opened. In some embodiments, the first housing 2 and the second housing 3 may be arranged in a vertical direction. Alternatively, the first housing 2 and the second housing 3 may be arranged in a horizontal direction to each other.

An inner space S1 may be provided inside the first housing 2. The cleaning unit 110 and an inner housing 40, including a filtering unit 30 to be described below, may be mounted in the inner space S1. The shapes of the first housing 2 and the second housing 3 are shown by way of example, and may be modified in various ways. A dust collection space S1 may be provided between the inner surface of the first housing 2 and the outer surface of the filtering unit 30. The dust collection space S1 may be regarded as the inner space of the first housing 2. Here, the inner surface 20 of the first housing 2 refers to an inner circumferential surface of the first housing 2 corresponding to an opposite side of the outer surface of the first housing 2 exposed to the outside.

A handle part 5 may be provided at one side of the housing 1. The handle part 5 may be configured to be separated from the housing 1 and may be assembled with the housing 1, or at least a portion of the handle part 5 may be integrated with the housing 1. The handle part 5 may be a portion which a user grasps, and a switch 6 manipulated to be turned on and off may be provided at one side of the handle part 5. In some embodiments, a battery 7 may be mounted at the lower side of the handle part 5 to supply power for the operation of the cleaner.

An introduction opening 8 may be provided at one side of the housing 1. The introduction opening 8 may protrude to the opposite side of the handle part 5, and an introduction space 8' may be provided therein. When the cleaner operates, a suction force generated by a motor unit 10 may be transmitted to the introduction opening 8, and external air having dust may be introduced to the inner space S1 of the cleaner through the introduction opening 8 and the introduction space 8'. In FIG. 1, the introduction opening 8 is illustrated to be short, but various cleaning devices (not shown) may be coupled to the front of the introduction opening 8.

The air having dust is described above, and foreign matter having various sizes may be included in the dust. That is, the dust may include foreign matter of very fine sizes, or foreign matter of various sizes such as hair, sand, or cookie crumbs. Hereinafter, the various foreign matter may be referred to as dust for convenience.

Although described again below, a manipulation unit 150 will be described first for better understanding. As illustrated in FIG. 1, a manipulation housing 151 constituting the manipulation unit 150 may be coupled to the housing 1, and the manipulation lever 160 which may be configured to be raised and lowered may be assembled with the manipulation housing 151. When a user presses a button part 165 of the manipulation lever 160 downward, the cleaning unit 110 to be described below may compress dust contained in the dust collection space S located inside the first housing 2 while lowering in the inner space S1 of the cleaner, and at the same time, may clean the filtering unit 30 by scraping down the surface thereof. That is, when a user lowers only the manipulation lever 160 at the outside, even without opening the inner space S1 of the cleaner, dust contained inside the dust collection space S1 may be compressed. Further details regarding the structure of the manipulation unit are described below.

Figure 3:
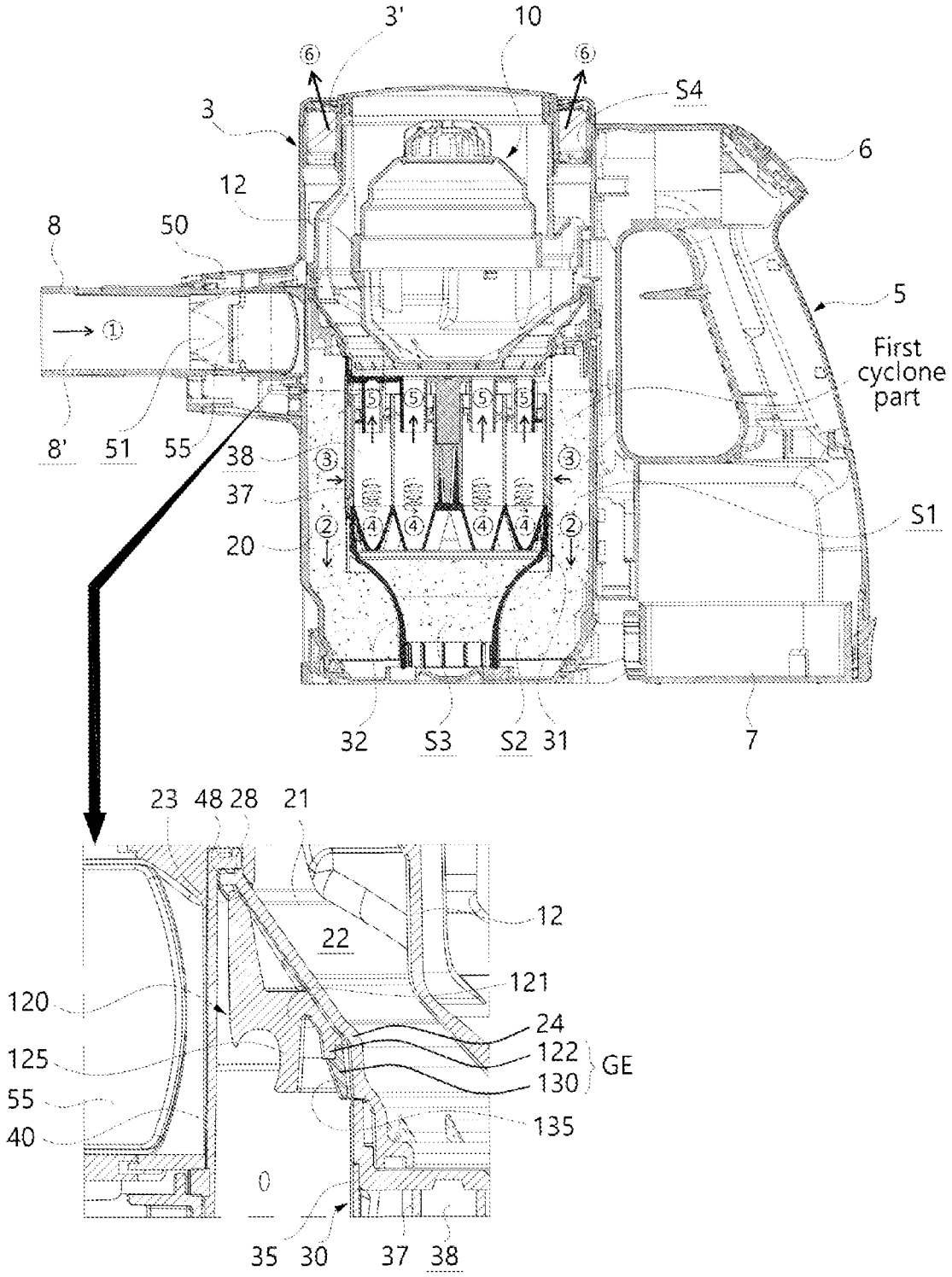
FIG. 3 is a sectional view taken along line I-I' of FIG. 1.

Referring to FIG. 3, a motor unit 10 may be mounted inside the second housing 3. The motor unit 10 mounted inside the second housing 3 may provide the suction force of the cleaner. Although not shown, the motor unit 10 may include an electric motor rotating by receiving power from a battery, and an impeller generating the suction force while rotating with a rotating shaft of the electric motor. Accordingly, the motor unit 10 may be mounted inside the second housing 3, but in FIG. 3, only a motor case 12 in which the motor unit 10 is mounted is illustrated, and the electric motor, the rotating shaft, and the impeller are omitted.

Referring to FIGS. 2 and 3, an air guide 21 may be provided inside the housing 1. The air guide 21 may have the shape of a ring having a width that gradually narrows in a downward direction. The air guide 21 may include a through hole 22 provided at the center thereof. The outer surface of the air guide 21 may guide the flow of air introduced through an introduction flow path 51 of the introduction opening 8. The outer surface of the air guide 21 may have an inclining shape, and the introduced air may be naturally induced downward.

An air guide surface 23 guiding the flow of air may be provided on the upper portion of the air guide 21 and may have an inclining shape. The diameter of the air guide 21 may gradually decrease toward the bottom of the dust collection space S1, such that the air guide surface 23 is a naturally inclining surface. When the cleaning unit 110 to be described below is located at an initial position (see FIG. 3), the cleaning unit may surround the outer side of the air guide surface 23, and the introduced air may be prevented from flowing through the air guide surface 23. However, when the cleaning unit 110 is moved to the lowered position, the air guide surface 23 may face the introduction flow path 51 communicating with the introduction opening 8, and thus may guide the flow of the introduced air (see FIG. 4).

For reference, the initial position refers to a position at which the cleaning unit 110 moves to a top position and communicates with an air introduction path of the introduction opening 8, and the lowered position refers to a position at which the cleaning unit 110 lowers, compresses dust contained in the dust collection space S1, and scrapes off dust on the outer surface of the filtering unit 30.

A combination end 24 may protrude at the lower side of the air guide surface 23. The combination end 24 may be a part by which the air guide 21 may be assembled with the filtering unit 30 to be described below, and may correspond to a part protruding more than the lower side of the air guide surface 23 thereto. An assembly key 27 may protrude from the combination end 24. The assembly key 27 may be inserted to an assembly groove 36 of the filtering unit 30, so the assembling of the air guide 21 and the filtering unit 30 to each other may be performed. The assembly key 27 and the assembly groove 36 may be assembled to each other in a rotating manner.

An assembly boss 26 may protrude from the air guide 21 by extending in a direction of the upper side thereof, that is, in a direction of the second housing 3. The assembly boss 26 may allow the air guide 21 to be assembled even with the motor case 12 located inside the second housing 3. The assembly boss 26 may be assembled with the motor case 12 by a fastener such as a bolt.

A holding end 28 may be formed on the edge of the upper end of the air guide 21. The holding end 28 may be formed by surrounding the edge of the upper end of the air guide 21. When the air guide 21 is assembled with the inner housing 40 to be described below, a corresponding holding portion 48 located on an edge of the inner side of the inner housing 40 may be held in the holding end 28. Such a configuration can be clearly seen in the enlarged view of FIG. 3.

The air guide 21 may be assembled with the filtering unit 30. A cyclone part may be provided inside the filtering unit 30. More precisely, in some embodiments, a first cyclone part (a reference numeral not assigned) and a second cyclone part 37 may be provided inside the cleaner. The second cyclone part 37 may be provided inside the filtering unit 30. Dust may be more effectively filtered due to the provision of the first cyclone part and the second cyclone part 37. In some embodiments, the first cyclone part may not be provided as a separate component, but may be formed by the inner surface 20 of the housing 1, the air guide 21, and the cleaning unit 110.

The filtering unit 30 may be mounted at the center of the inner space S1 of the first housing 2, and may define the dust collection space S1 between the filtering unit 30 and the inner surface of the first housing 2. The dust collection space S may be defined at the lower side of the inner space S1 of the first housing 2, and may form a first dust storage part S2 in which dust is accumulated.

In this case, the second cyclone part 37 may be located inside the first cyclone part such that the size of the housing 1 is minimized. Referring to FIG. 3, the second cyclone part 37 may include multiple cyclone bodies arranged in parallel. Air may flow through a path 38 of each of the cyclone bodies. In the path 38, a centrifugal force may cause air to rise, and foreign matter to fall downwards.

A dust guide 31 may be provided at the lower side of the second cyclone part 37. The dust guide 31 may include a guide body 32 having a width that gradually decreases toward the lower side thereof like a kind of hopper, and a second dust storage part S3 may be provided inside the guide body 32 to store dust separated from the air in the second cyclone part 37. The second dust storage part S3 may be formed at the center of the housing 1 and may be separated from the first dust storage part S2 by the guide body 32.

Referring to FIG. 3, the air flow in the cleaner will be described. While air (flowing in the direction of arrow ①) and dust introduced through the introduction opening 8 by the operation of the motor unit 10 flow along the inner circumferential surface of the first cyclone part, the air and dust may be separated from each other.

The dust separated from the air may flow downward (as shown by the direction of arrow ②), and may be stored in the first dust storage part S2. The air separated from the dust may flow to the second cyclone part 37. In this case, the air may flow through the filtering unit 30 (as shown by arrow ③). In the process of passing through the filtering unit 30, the air may pass through a mesh net 35 located on the outer surface of the filtering unit 30. In the process, dust having large particles may also be filtered through narrow holes formed in the mesh net 35.

In addition, the air flowing to the second cyclone part 37 may be once again separated from the dust by centrifugal force. The dust separated from the air in the second cyclone part 37 may move downward, and be stored in the second dust storage part S3 (as shown by arrow ④).

Meanwhile, air separated from the dust in the second cyclone part 37 may be discharged from the second cyclone part 37 and rise toward the motor unit 10 (in the direction of arrow ⑤). The risen air may pass through a pre-filter (not shown) located at the outer side of the motor unit 10. Air passing through the pre-filter may pass through the motor unit 10, and then pass through a HEPA filter located at the discharge space S4 of the second housing 3, and be discharged to the outside (in the direction of arrow ⑥) through an air discharge opening 3'. Here, at least one of the pre-filter or the HEPA filter may be omitted.

In this case, the dust separated from the cyclone part may be accumulated in the first dust storage part S2 and the second dust storage part S3. The weight of the dust is light, so when a user opens the first housing 2 (which is the dust container), the dust may scatter to the outside. That is, the dust collected inside the dust container may not be brought together into one lump, and may be difficult to be emptied. In some embodiments, to solve such a problem, a cleaning module 100 may be provided. The cleaning module 100 may include the cleaning unit 110 compressing dust and the manipulation unit 150 for moving the cleaning unit 110.

Figure 4:
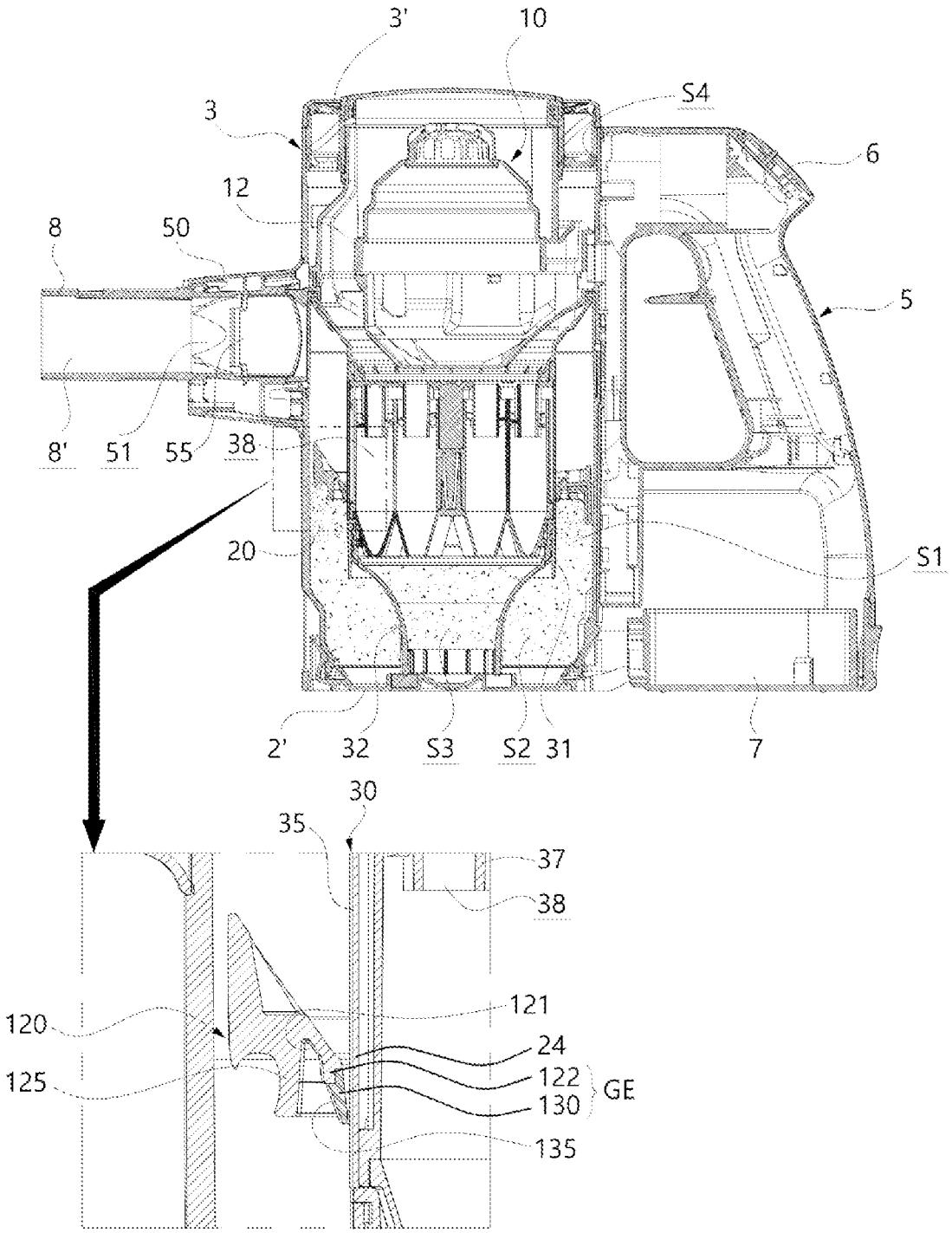
FIG. 4 is a sectional view illustrating a lowered state of an example cleaning unit.

For reference, in FIG. 4, the cleaning unit 110 is illustrated to lower and scrape off dust on the outer surface of the filtering unit 30. Referring to FIG. 4, the cleaning body 120 and a cleaning ring 130 constituting the cleaning unit 110 are lowered toward the lower portion of the dust collection space S1. In the process of the lowering of the cleaning unit 110, the cleaning unit 110 may compress the dust, and the cleaning ring 130 may push down the dust on the outer surface of the filtering unit 30. As illustrated in FIG. 4, dust of the upper portion of the inner space is illustrated to be in a compressed state by being pressed down by the cleaning body 120 and the cleaning ring 130. These components will be described again below.

Referring back to FIG. 2, the mesh net 35 may be provided on the outer surface of the filtering unit 30. The mesh net 35 may be mounted to the filtering unit 30 so as to surround the outer surface thereof, and may function to filter dust contained in air introduced to the second cyclone part 37 from the dust collection space S1. To this end, multiple holes may be formed in the mesh net 35. When the cleaner is used, the holes may be completely or partially blocked by dust and thus may require cleaning. The cleaning of such a mesh net 35 may be performed by the cleaning unit 110.

The inner housing 40 may be mounted to the upper portion of the filtering unit 30. The inner housing 40 may be provided in the inner space S1 of the housing 1. In some embodiments, a portion of the inner housing 40 may be arranged inside the first housing 2, and the remaining portion thereof may be arranged inside the second housing 3. The inner housing 40 may have the shape of an approximate circular frame, and may surround the outer sides of the air guide 21 and the cleaning unit 110 when mounted inside the inner space S.

A through-space 41 open in an upward and downward direction may be defined at the center of the inner housing 40. The air guide 21 and the cleaning unit 110 may be located in the through-space 41. As illustrated in FIG. 3, the cleaning unit 110 at the initial position may be located inside the inner housing 40, and the air guide 21 may be located at a side closer to the center of the cleaner than cleaning unit 110. The inner housing 40 may surround the cleaning unit 110 at the initial position and may guide at least a portion of the cleaning unit 110 during the raising and lowering of the cleaning unit 110.

Figure 17:
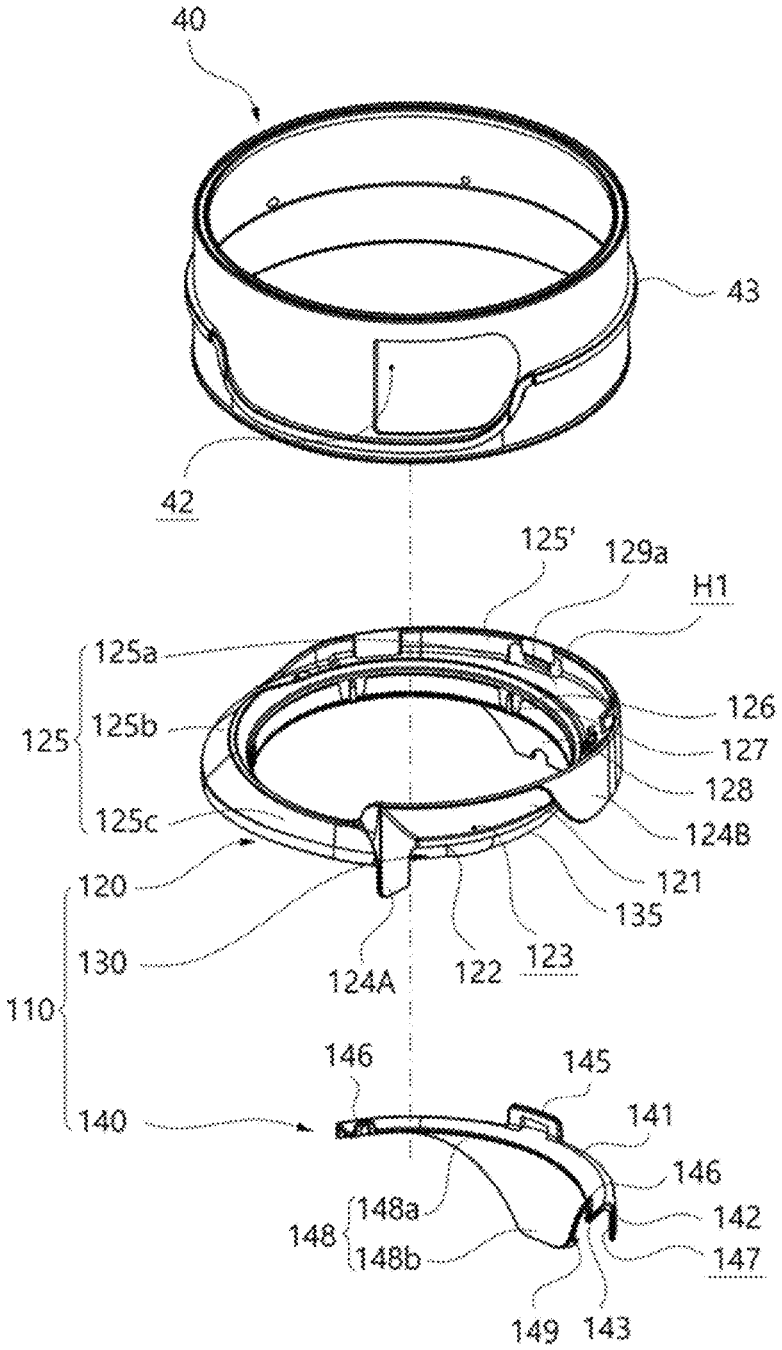
FIG. 17 is an exploded perspective view of each of the components of FIG. 15.
Figure 18:
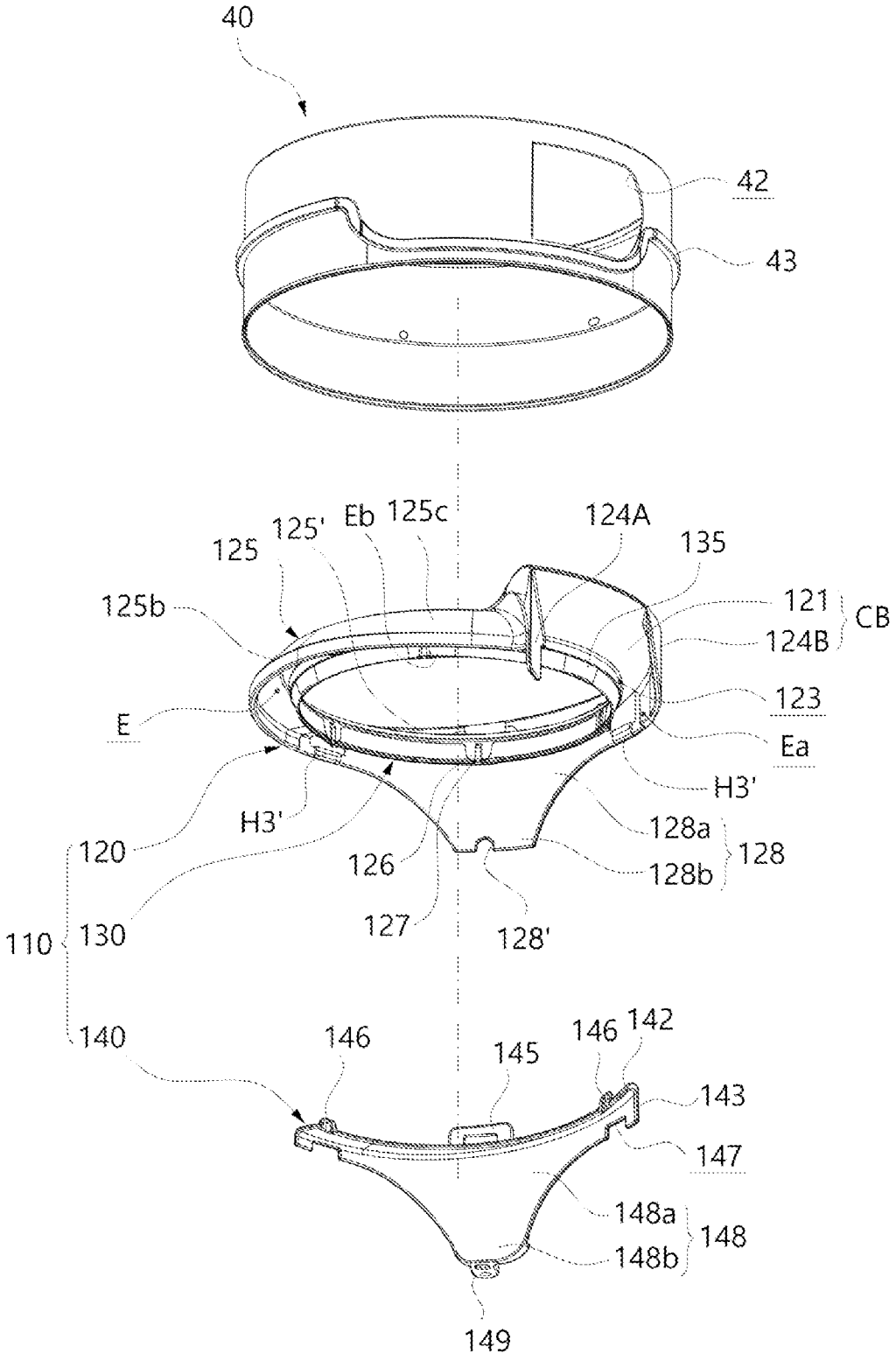
FIG. 18 is an exploded perspective view of each of the components of FIG. 15 viewed at a different angle from FIG. 17.

A communication window 42 may be open at one side of the inner housing 40. The communication window 42 may be a portion connecting the introduction flow path 51, which is connected to the introduction opening 8, to the inner space S1. In some embodiments, as shown in FIG. 17, the communication window 42 may have an approximate "D" shape. The introduction opening 8 and the cleaning unit 110 located at an inner side thereof may communicate with each other by the communication window 42.

A sealing member 43 may be provided on the outer surface of the inner housing 40. The sealing member 43 may be provided along the outer surface of the inner housing 40, and may limit an air flow between the upper portion and the lower portion of the sealing member 43 relative thereto. That is, the sealing member 43 may induce air to flow only along a formed path. For reference, the inner housing 40 may be omitted, or the first housing 2 or the second housing 3 may be intentionally provided.

Referring to FIG. 2, an introduction housing 50 may be connected to the introduction opening 8. The introduction housing 50 may be assembled with the introduction opening 8, for example by surrounding the introduction opening 8, or may be provided integrally to the introduction opening 8. The introduction housing 50 may connect the introduction opening 8 to the housing 1, and may be larger in diameter than the introduction opening 8. The introduction flow path 51 communicating with the introduction space 8' of the introduction opening 8 may be provided inside the introduction housing 50.

Next, the cleaning module 100 will be described below. The cleaning module 100 may generally include the cleaning unit 110 and the manipulation unit 150 allowing the cleaning unit 110 to be operated. As illustrated in FIG. 2, the cleaning unit 110 and the manipulation unit 150 may be separate components and may be assembled with each other to constitute one cleaning module 100. At least some components, including the manipulation lever 160 of the manipulation unit 150, may protrude to the outside of the housing 1, and a user may use the cleaning module 100 from the outside of the housing 1.

Figure 5A:
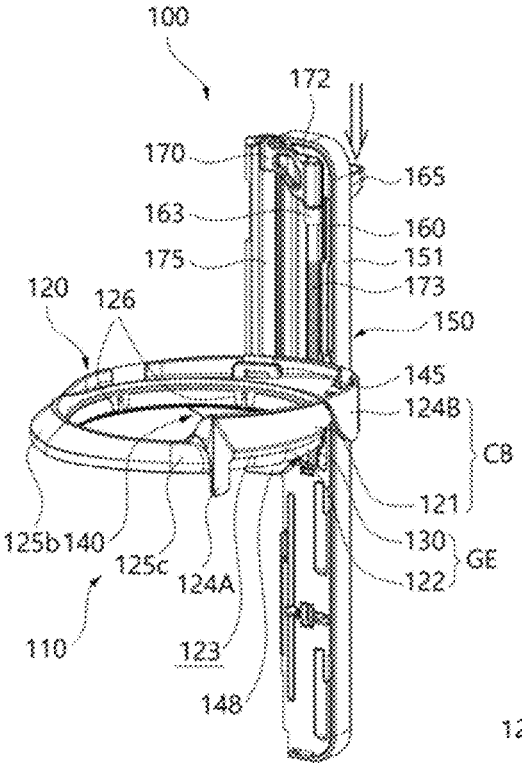
FIGS. 5A and 5B are perspective views illustrating an example cleaning unit and manipulation unit with the cleaning unit in an initial position and a lowered position, respectively.
Figure 5B:
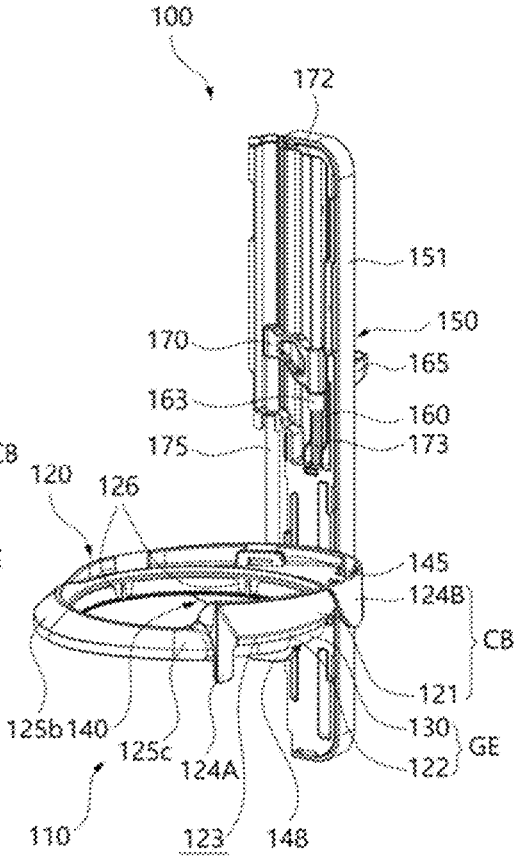

FIGS. 5A and 5B illustrate an example cleaning module 100 according to some embodiments of the present disclosure. As illustrated in FIGS. 5A and 5B, the manipulation unit 150 constituting the cleaning module 100 may be provided along the raising/lowering direction of the cleaning unit 110, and the cleaning unit 110 may be mounted in a direction orthogonal to the manipulation unit 150. The cleaning unit 110 may extend in the form of a cantilever from the manipulation unit 150. Accordingly, the cleaning unit 110 may easily become eccentric while raising and lowering. When the cleaning unit 110 is eccentric, the filtering unit 30 located at the center thereof may interfere with the cleaning unit 110, so the raising and lowering of the cleaning unit 110 may be interrupted. The structure of a gap maintenance rib 127 for solving this problem is described below.

FIG. 5A illustrates the state of the cleaning unit 110 located at the initial position which is a first position thereof, and FIG. 5B illustrates the state of the cleaning unit 110 located at a lowered position thereof which is a second position thereof after the cleaning unit 110 lowers. While the cleaning unit 110 is moving from the initial position to the lowered position, the cleaning unit 110 may compress dust contained in the dust collection space S1 and may scrape dust off of the mesh net 35 in a downward direction. As used herein, a lowered state may not necessarily refer to the fully lowered state, and may include any state in which the cleaning unit 110 is lower relative to the initial state. For example, as shown in FIG. 4, the cleaning unit 110 may be considered to be in a lowered state although it is not at the lowest position. In FIG. 5B, the cleaning unit 110 is located at the lowered position by moving relatively further downward.

Referring to the structure of the manipulation unit 150, the manipulation housing 151 of the manipulation unit 150 may be coupled to the outer surface of the housing 1 described above, and may extend in a vertical direction from the first housing 2 to the second housing 3. Two or more rails may be provided in the manipulation housing 151, which may include a fixed rail 172 and a movable rail 175. The fixed rail 172 and the movable rail 175 may be mounted in longitudinal directions (the vertical directions) of the manipulation housing 151. The fixed rail 172 may be in a fixed state, and the movable rail 175 may raise and lower together with the cleaning unit 110. In some embodiments, each of the fixed rail 172 and the movable rail 175 may have the shape of a thin and long rod.

The manipulation lever 160 may be connected to the fixed rail 172, and may raise and lower along fixed rail 172. The button part 165 may be provided in the manipulation lever 160. The manipulation lever 160 may be located inside the manipulation housing 151 and may not be exposed to the outside, but the button part 165 may be exposed to the outside of the manipulation housing 151 such that a user may press the button part 165. When the user presses the button part 165, the manipulation lever 160 may lower the movable rail 175 while lowering along the fixed rail 172.

More precisely, a connection block 170 may be connected to the button part 165. The connection block 170 may be located at the inner side of the manipulation housing 151 and may raise and lower along the button part 165. The connection block 170 may be fitted over the fixed rail 172 so as to raise and lower along fixed rail 172 and may be connected to the movable rail 175. Accordingly, the connection block 170, together with the button part 165, may raise and lower along the fixed rail 172, and in the process, may raise and lower the movable rail 175. As illustrated in FIG. 5A, the connection block 170 may be mounted in a direction across the fixed rail 172 and the movable rail 175. Reference numeral 163 is a press end coupled to the connection block 170, and may be a part compressing a spring 173 during the lowering of the connection block 170.

Reference numeral 173 refers to the spring 173. The spring 173 may be assembled with the fixed rail 172 by being fitted thereover and may be located at a position lower than a position of the manipulation lever 160. The spring 173 may be compressed in as the connection block 170 is lowering together with the manipulation lever 160. When a force of pressing the button part 165 is released, the spring 173 may restore the manipulation lever 160 to an initial position, that is, to the state shown in FIG. 5A, while the spring 173 is restored to an initial shape. In some embodiments, the spring 173 may be omitted.

The movable rail 175 may be mounted to the manipulation housing 151 and be connected to the manipulation lever 160, and thus may raise and lower together with the manipulation lever 160. One end of the movable rail 175 may be connected to a connecting plate 128 (hereinafter, also referred to as a connection part) of the cleaning unit 110, as described below. Accordingly, the movable rail 175 and the cleaning unit 110 may raise and lower together. The movable rail 175 and the connection part of the cleaning unit 110 may be parts on which a load is focused due to an external force, and thus may be easily damaged or deformed. Structures of the connecting plate 128 and a reinforcement plate 140 for solving this problem will be described in detail below.

Next, the cleaning unit 110 will be described. The cleaning unit 110 may be mounted to surround the filtering unit 30, and may be raised and lowered inside the dust collection space S1 by the manipulation unit 150. In this case, at least a portion of the cleaning unit 110 located at the initial position thereof may communicate with the air introduction path extending from the introduction opening 8 and thus the cleaning unit may function to guide the flow of the air. Here, the connection of the portion of the cleaning unit 110 and the air introduction path to each other may mean that at least the portion of the cleaning unit 110 is located in the air introduction path. The air introduction path may be regarded to include the introduction space 8' of the introduction opening 8 and the introduction flow path 51 of the introduction housing 50.

That is, the cleaning unit 110 (*i*) may function to guide the flow of the introduced air at the initial position, (ii) to compress dust contained in the dust collection space S1 in the process of lowering, (iii) to allow a guide edge GE thereof to scrape the mesh net 35 of the filtering unit 30 and remove dust thereon while raising and lowering.

Figure 6:
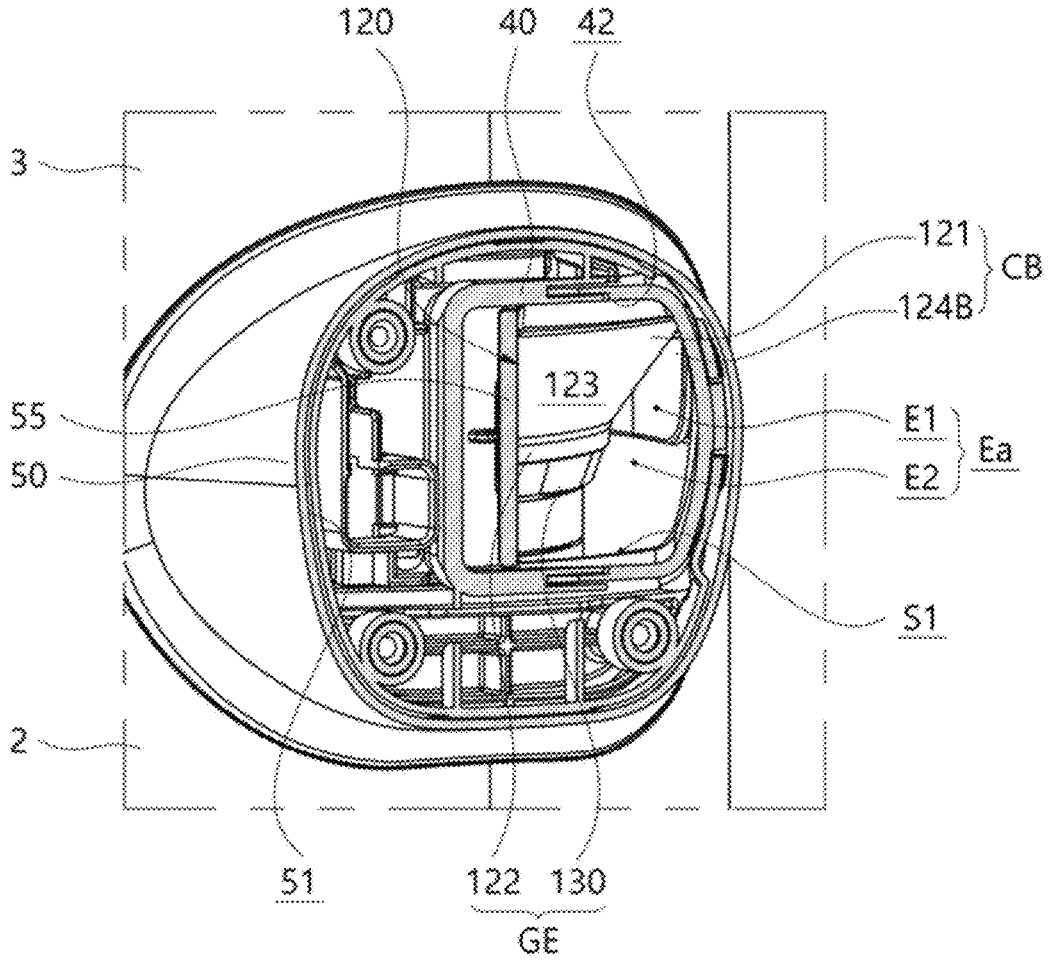
FIG. 6 is a sectional view taken along line II-II' of FIG. 1.

Referring to FIG. 6, the cleaning unit 110 can be seen to be connected to the introduction flow path 51 of the introduction housing 50. Reference numeral Ea refers to the entrance Ea of the guide flow path E, and air may flow spirally along the guide flow path E (see FIGS. 7 and 10). That is, the cleaning unit 110, the inner surface 20 of the housing 1, and the air guide 21 may constitute the first cyclone part such that the introduced air first flows in cyclone. As described again below, referring to the entrance Ea of the guide flow path E, the guide flow path E may include a first guide flow path E1 located at a relatively upper portion and formed between a guide wall 121 and a guide fence 124B of the cleaning body 120, and a second guide flow path E2 located at a relatively lower portion and formed between the guide edge GE and the inner surface 20 of the housing 1.

Figure 7:
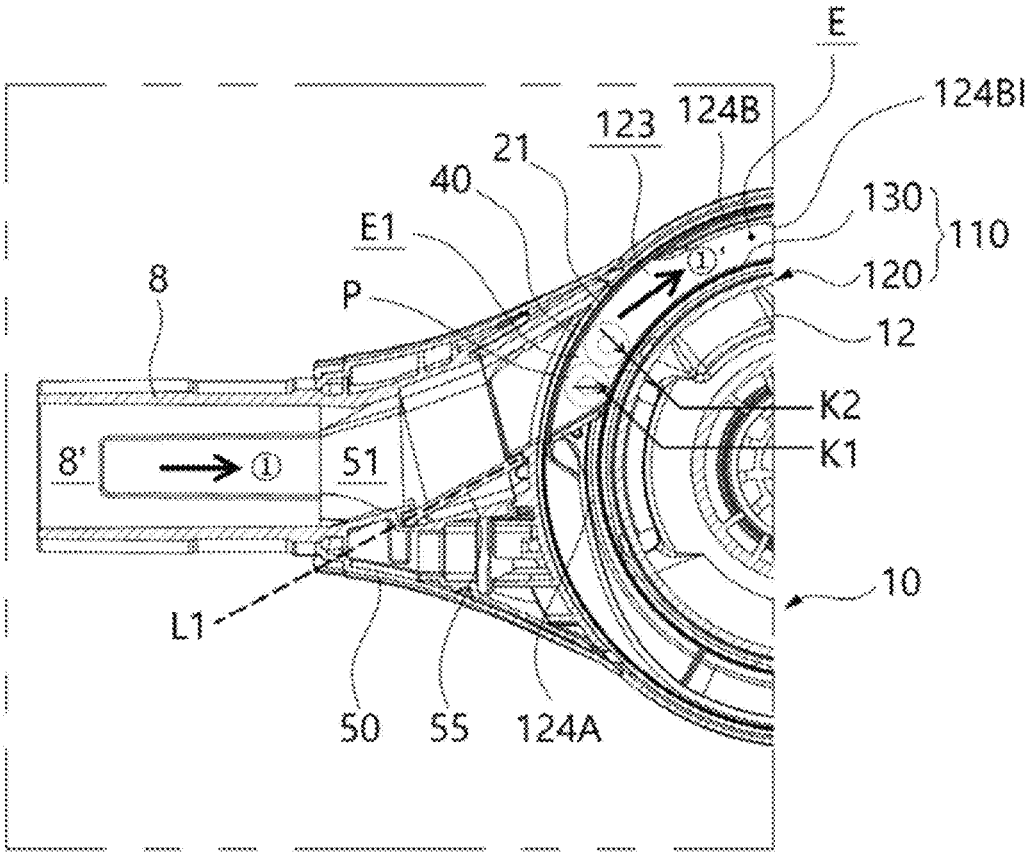
FIG. 7 is a cross-sectional view taken along line III-II' of FIG. 1.

FIG. 7 is a cross-sectional view of the cleaner viewed from the lower side thereof such that the introduction opening 8 and the introduction flow path 51 are clearly seen. External air may be introduced along the introduction space 8' located inside the introduction opening 8 and pass through the introduction flow path 51 of the introduction housing 50 (in the direction of arrow ①). The introduced air may be introduced to the inner space through an air introduction part 123. The air introduction part 123 may be provided at the 14) entrance Ea of the guide flow path E of the cleaning unit 110, and may communicate with the air introduction path. The air introduction part 123 at which a portion of the guide fence 124B is omitted may function to communicate an air flow path with the introduction opening 8. Referring to FIG. 7, the air introduction part 123 may communicate with the introduction flow path 51 through the communication window 42 of the inner housing 40.

Referring back to FIG. 7, the air introduction part 123 may open the entrance Ea of the guide flow path E, and the introduced air and dust contained in the air may forcefully collide with the cleaning unit 110 at the entrance Ea of the guide flow path E. K1 and K2 indicate the examples of directions in which dust collides with the cleaning unit 110. After the collision, the dust may be introduced further inward along the guide flow path E (in a direction of arrow ①').

In this case, when flat foreign matter P is introduced to the entrance Ea in an upright orientation (in an orientation of height larger in size than width), the foreign matter may efficiently pass through the entrance Ea of the guide flow path E which is narrow in width. However, when the foreign matter P is introduced to the entrance Ea with strong force in a horizontal orientation (in an orientation of width larger in size than height), the foreign matter P may collide with the cleaning unit 110, and then be bounced toward the inner surface 20 of the housing 1 or the inner surface of the inner housing 40 by a reaction force to the collision and may be held therebetween. Referring to FIG. 7, large foreign matter P may collide with the cleaning unit 110 (in directions of K1 and K2) and may be bounced toward the inner surface 20 of the housing 1 by the reaction force to the collision, and the foreign matter may be held therebetween. Such a holding may be prevented by the guide edge GE as described further below. Additional details regarding the structure for preventing this holding will be described further below.

In some embodiments, a guide blade 55 may be provided in the introduction housing 50. As illustrated in FIGS. 3, 6, and 7, the guide blade 55 may be a plate-shaped structure installed to block one side of an exit Eb of the introduction flow path 51. The guide blade 55 may set the path of the introduced air, and more precisely, may induce the flow of air to the entrance Ea of the guide flow path E.

Figure 8:
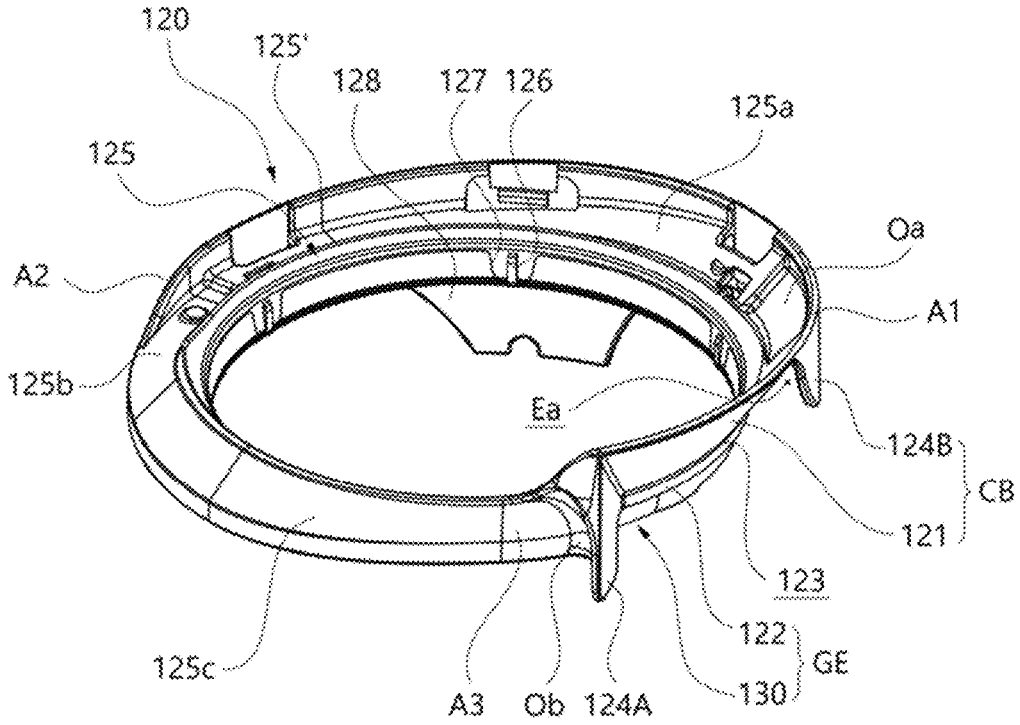
FIG. 8 is a perspective view illustrating an example configuration of the cleaning unit according to the embodiment of the present disclosure.

Referring to FIGS. 7 and 8, a duct blade 124A may be mounted to the cleaning body 120 of the cleaning unit 110. The duct blade 124A may be configured to block one side of the air introduction part 123. The duct blade 124A may allow the flow path of air to be formed in one direction relative to the duct blade 124A, that is, toward the entrance Ea of the guide flow path E. Furthermore, the duct blade 124A may have a shape extending longitudinally in the raising/lowering direction of the cleaning unit 110 and may increase the strength of the cleaning body 120.

As illustrated in FIG. 7, the duct blade 124A of the cleaning unit 110 and the guide blade 55 of the introduction housing 50 may be continuously arranged along an imaginary extension line L1. That is, the duct blade 124A and the guide blade 55 may form one continuous air flow path and may allow the introduced air to flow to the entrance Ea of the guide flow path E through the air introduction opening. In some embodiments, the imaginary extension line L1 may be a straight line. Alternatively, the imaginary extension line L1 may be a curved line or a line bent at a predetermined angle.

Next, referring to FIGS. 8 to 10, the cleaning unit 110 will be described further in detail. Referring to FIG. 8, the cleaning unit 110 may mainly be composed of the cleaning body 120 and the guide edge GE. The cleaning body 120 may be a ring-shaped structure that forms the appearance of the cleaning unit 110, and the guide edge GE may extend from the lower end of the cleaning body 120. In some embodiments, the guide edge GE may be composed of the coupling end part 122 of the cleaning body 120 and the cleaning ring 130. Alternatively, only the cleaning ring 130 may constitute the guide edge GE. The guide edge GE may be a closed curve path having a ring shape. At least a portion of the guide edge GE may be located in the air introduction path extending from the introduction opening 8, and may guide the flow of the introduced air.

The cleaning body 120 may have an approximate ring shape surrounding the filtering unit 30, and may be connected to the manipulation unit 150. The cleaning body 120 may include the guide wall 121 and the guide fence 124B. The guide wall 121 and the guide fence 124B may be configured to be integrated with each other. The guide wall 121 may continuously extend in the circumferential direction of the cleaning body 120, and have the inclining surface on the surface thereof, and the guide edge GE may be provided on the lower portion thereof.

In addition, the guide fence 124B may extend parallel to the guide wall 121 and may be spaced apart from the guide wall 121 in a direction of the inner surface 20 of the housing 1. Accordingly, the guide flow path E which is the air flow path may be formed between the guide fence 124B and the guide wall 121. More precisely, since the guide fence 124B is omitted in the air introduction part 123, the guide flow path E may be formed between the outer surface of the guide wall 121 and the inner surface 20 of the housing 1. In a side further inward from the air introduction part 123, the guide flow path E may be formed between the outer surface of the guide wall 121 and the inner surface 124BI of the guide fence 124B (see FIG. 7). That is, the guide wall 121 and the guide fence 124B may form a guide duct CB. The guide flow path E may be open in a direction of the dust collection space S1 located thereunder, and may induce the flowing air downward.

Here, the guide fence 124B may be omitted. When the guide fence 124B is omitted, the guide flow path E, which is the air flow path, may be formed between the guide wall 121 and the inner surface 20 of the housing 1.

The coupling end part 122 may be provided on the lower end of the guide wall 121. The coupling end part 122 may be a portion extending downward from the lower end of the guide wall 121, and the cleaning ring 130 may be coupled thereto. The surface of the coupling end part 122 and the surface of the cleaning ring 130 may constitute the guide edge GE, and may constitute a guide inclination surface 135. That is, the surface of the coupling end part 122 may be gradually inclined downward toward the dust collection space S1, so an inclining surface may be formed on the surface thereof. Such an inclining surface may induce some of the reaction forces occurring during collision of large foreign matter with the inclining surface to be directed downward. A more detailed description of the configuration of the coupling end part 122 is provided below.

The guide wall 121 may be provided in an inclining direction to the raising/lowering direction of the cleaning unit 110, and may guide the flow of the air introduced through the introduction opening 8 when the cleaning unit 110 is located at the initial position. Referring to FIGS. 6 and 8, the outer surface of the guide wall 121 can be seen to extend slantingly. Since the outer surface of the guide wall 121 may extend to incline downward, the guide wall 121 may efficiently move the air downward.

Preferably, the guide wall 121 of the cleaning body 120 may extend to incline such that a gap between the guide wall 121 and the inner surface 20 of the housing 1 increases downward toward the guide edge GE, and may induce the flow of air downward, and the width of the guide wall 121 may be increased to improve the air flow.

Figure 9:
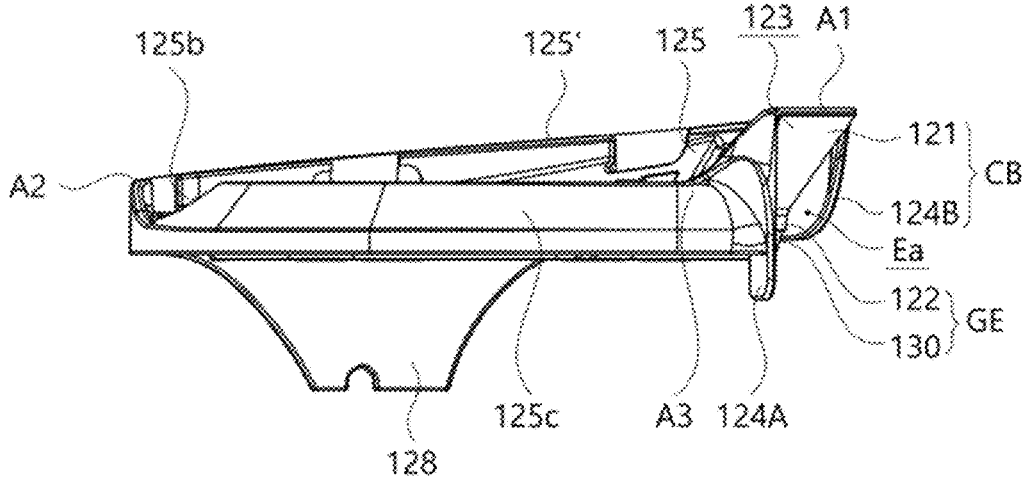
FIG. 9 is a front view of the configuration of the cleaning unit illustrated in FIG. 8.

In addition, referring to FIGS. 8 and 9, the guide wall 121 and the guide fence 124B may be the highest at the entrance Ea of the guide flow path E. The heights thereof may gradually decrease along the circumferential direction thereof; and may be the lowest at a position adjacent to the duct blade 124A corresponding to the exit Eb of the guide flow path E. Accordingly, the sectional area of the guide flow path E may also gradually decrease along the air flow direction of the guide flow path E. At the same time, the guide flow path E may form an air flow path that gradually lowers toward the exit Eb. Such a structure may function to form an air cyclone flow due to the first cyclone part.

The connecting plate 128 may be provided in the cleaning body 120. As illustrated in FIGS. 8 and 9, the connecting plate 128 may have the structure of a plate shape extending in the raising/lowering direction of the cleaning unit 110, and may raise and lower in the state of being in close contact with the inner surface 20 of the housing 1. The connecting plate 128 may be a part connecting the manipulation unit 150 with the cleaning body 120.

The cleaning body 120 may be configured to extend in the form of a cantilever from the manipulation unit 150 (see FIGS. 5A and 5B). Accordingly, a large load may be applied to the connection part located between the manipulation unit 150 and the cleaning body 120. Accordingly, the connection part may be required to be reinforced. To this end, the connecting plate 128 may extend along the raising/lowering direction of the cleaning unit 110 and may provide a wide connection part. In some embodiments, the reinforcement plate 140 may be correspondingly coupled to the connecting plate 128, so the strength of the connection part may be further reinforced, as described below.

The connecting plate 128 may extend from the cleaning body 120 while gradually becoming narrower in width in left and right width directions toward a position far from the cleaning body 120. Due to the widths in the left and right direction of gradually becoming narrower, the volume of the connecting plate 128 occupying the dust collection space S1 therein may be decreased and air flow may not be prevented. Furthermore, a connection bracket 149 connected to the manipulation unit 150 may be provided in an end portion of the connecting plate 128 that decreases in width, such that the connecting plate 128 may be connected directly to the manipulation unit 150. However, in some embodiments, the connecting plate 128 may be connected to the manipulation unit 150 by the reinforcement plate 140, as described below. In FIG. 8, reference numeral 128' may refer to an assembly groove which allows the connection bracket 149 to protrude toward the rear of the connecting plate 128.

Figure 10A:
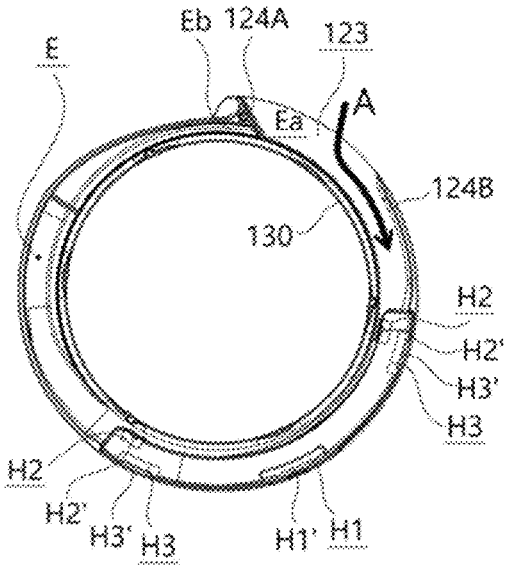
FIGS. 10A and 10B are a top plan view and a bottom view, respectively, illustrating the configuration of the cleaning unit illustrated in FIG. 8.

Referring to FIG. 10A, the guide flow path E formed between the guide wall 121 and the guide fence 124B may be continuously formed along the circumferential direction thereof from the entrance Ea of the guide flow path E to the exit Eb thereof, and arrow A may refer to a path through which air is introduced and flows. The guide flow path E may extend to have a predetermined width, and the width thereof may become narrow at the exit Eb (i.e. at the position of the duct blade 124A), so the air flow velocity may increase. In some embodiments, the guide wall 121 may be provided along the entire path of the guide flow path E, but the guide fence 124B may be omitted at the air introduction part 123 for the introduction of air through the introduction opening 8.

Meanwhile, an upper cleaning part 125 may be formed on the upper surface of the cleaning body 120 corresponding to the opposite side of the guide flow path E. The upper cleaning part 125 may be provided as a continuous path along the circumferential direction of the cleaning body 120. When air flows toward the upper cleaning part 125, dust accumulated on the upper surface of the cleaning body 120 may be removed. Most of the introduced air may flow along the guide flow path E, but some of the air may be introduced to the upper side of the cleaning body 120 such that dust may accumulate on the upper surface of the cleaning body 120. Even when air is introduced while the cleaning unit 110 is lowered, dust may be accumulated on the upper surface of the cleaning body 120. The dust may be removed through the structure of the upper cleaning part 125.

Referring to FIG. 8, the entrance Oa of the upper cleaning part 125 starting at a position adjacent to the air introduction part 123 may be formed at a location higher than the exit Ob of the upper cleaning part 125. That is, the height of the upper cleaning part 125 may gradually decrease along a circumferential direction from the entrance Oa to the exit Ob. Referring to FIG. 8, a first section 125*a* constituting the upper cleaning part 125 may be the highest portion, and a second section 125*b* extending from the first section 125*a* may be lower than the first section 125*a*. Furthermore, a third section 125*c* may be a portion closest to the duct blade 124A which is the exit Ob and may be lowest.

In this case, the height of the upper cleaning part 125 may decrease from the first section 125*a* toward the third section 125*c*, but the height of a middle portion therebetween may slightly increase. For example, to reinforce the strength of the cleaning body 120, a section in which the height of the upper cleaning part 125 increases may be provided. In some embodiments, the height of a portion of the second section 125*b* may slightly increase and then decrease.

An upper fence 125' may protrude from the edge of the cleaning body 120. The upper fence 125' may form the flow path of air flowing in the upper cleaning part 125. The upper fence 125' may protrude upward from the edge of the upper surface of the cleaning body 120, and thus may constitute a portion of the upper cleaning part 125, and face the inner space S1 of the housing 1. The upper fence 125' may be provided from the first section 125*a* to the second section 125*b*, but may not be omitted in the third section 125*c*. This is because the third section 125*c* may be a section in which the air flowing along the circumferential direction of the cleaning body 120 is discharged.

Figure 10B:
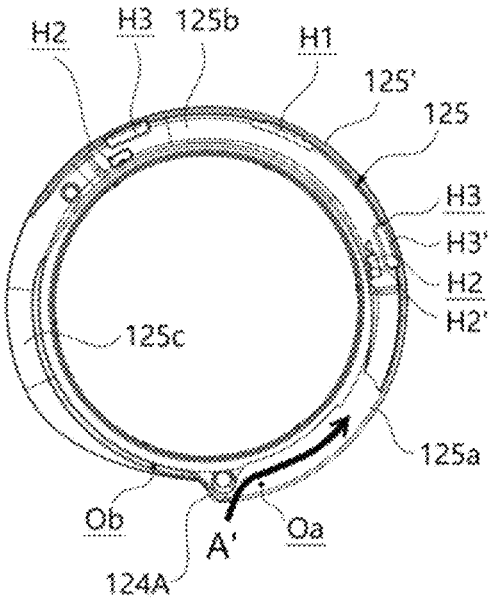

Referring to FIG. 10B, the widths of the first section 125*a* and the second section 125*b* may be similar to each other, but the width of the third section 125*c* may become relatively narrower. Accordingly, the exit Ob of the upper cleaning part 125 may be spaced apart from the inner surface 20 of the housing 1, and space may be defined therebetween. The introduced air may flow downward toward the dust collection space S1 through the space. In FIG. 10B, arrow A' indicates a direction in which the air introduced to the upper portion of the cleaning body 120 flows along the upper cleaning part 125.

Figure 11:
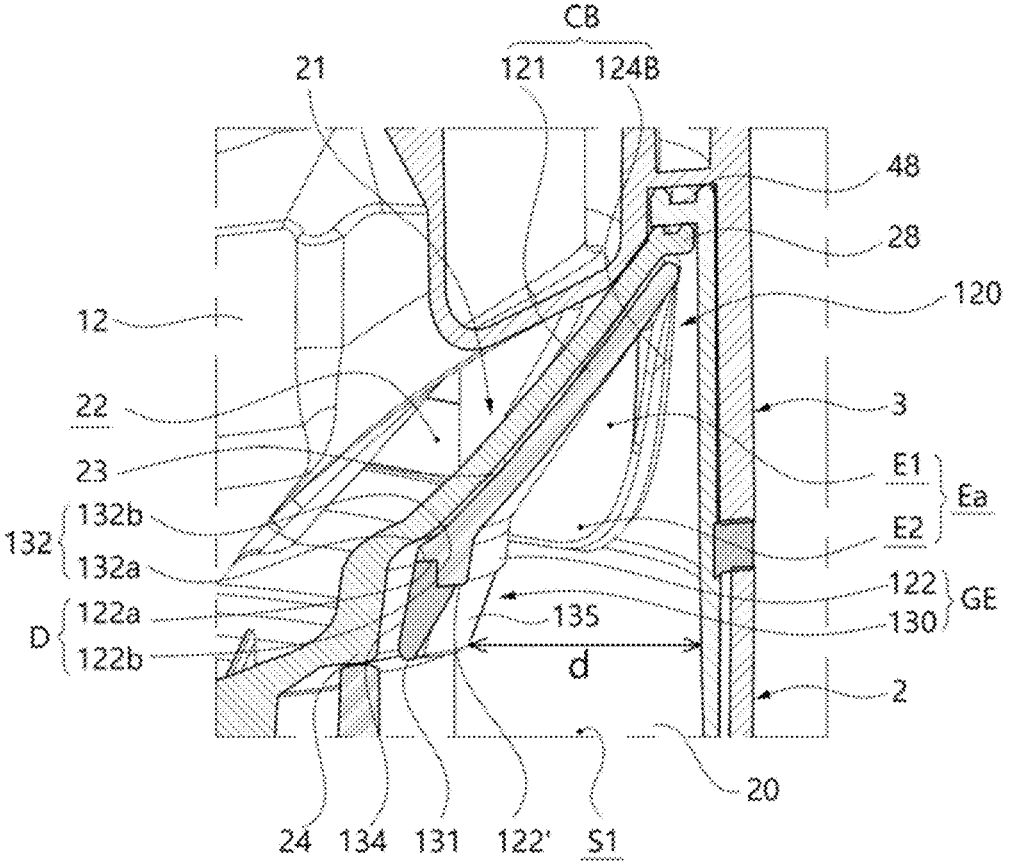
FIG. 11 is a sectional view illustrating an example configuration of an air introduction part to which air is introduced according to an embodiment of the present disclosure.

Referring to FIG. 11, the configuration of the cleaning unit 110 at a portion adjacent to the air introduction part 123 is illustrated in a cross-section view. FIG. 11 illustrates a state in which the cleaning unit 110 is located at the initial position. The cleaning unit 110 may be located by being fitted over the air guide surface 23 of the air guide 21. The cleaning unit 110 may be located at a side further outward than the air guide surface 23, and thus the introduced air may be guided by the cleaning unit 110.

The guide flow path E may be the path through which air flows. Referring to the entrance Ea of the guide flow path E, the guide flow path E may include the first guide flow path E1 located at a relatively upper portion and formed between the guide wall 121 and the guide fence 124B of the cleaning body 120, and the second guide flow path E2 located at a relatively lower portion and formed between the guide edge GE and the inner surface 20 of the housing 1. The first guide flow path E1 and the second guide flow path E2 may be connected to the air introduction part 123, and the air introduction part 123 may be regarded as a portion of the guide flow path E. The first guide flow path E1 and the second guide flow path E2 may be formed in the same way at the entrance Ea of the guide flow path E and along the guide flow path E.

The guide wall 121 may be provided in the cleaning body 120 constituting the cleaning unit 110. The gap between the guide wall 121 and the inner surface 20 of the housing 1 facing the guide wall 121 at the same height may gradually increase in the direction toward the bottom of the dust collection space S1. Accordingly, the inclining surface may be formed on the outer surface of the guide wall 121 and may induce air downward.

The coupling end part 122 may be located at the lower end of the guide wall 121. The coupling end part 122 may constitute the guide edge GE together with the cleaning ring 130, as described below. The guide edge GE may extend toward the bottom of the dust collection space S1, and the surface of the guide edge GE facing the inner surface 20 of the housing 1 may extend to be inclined to gradually increase the gap between the surface of the guide edge GE and the inner surface 20 of the housing 1 at the same height in a direction toward the end portion of the guide edge that is directed toward the bottom of the dust collection space S1.

In other words, the guide edge GE may extend such that the diameter of the cleaning unit 110 gradually becomes smaller toward the bottom of the dust collection space S1. Accordingly, the guide inclination surface 135 may be formed on the surface of the guide edge GE, and the width of the guide flow path E may increase toward the lower portion of the guide edge GE. Furthermore, the cleaning ring 130 may be slanted such that it is close to the surface of the second cyclone part 30 in the direction thereof toward the end portion of the cleaning ring toward the bottom of the dust collection space S, so that the guide inclination surface 135 is formed on the surface of the cleaning ring 130 facing the inner surface 20 of the housing 1.

Referring to FIG. 11, the surface of the guide wall 121 and the surface of the guide edge GE may be formed in inclining directions. Distance d between the surface of the guide edge GE (which is the surface of the guide inclination surface 135) and the inner surface 20 of the housing 1 may increase toward the lower side of the guide edge GE. This may increase the width of the flow path of the introduced air by increasing the distance d between the guide inclination surface 135 and the inner surface 20 of the housing 1 and to enable foreign matter to be induced downward by being rotated after the foreign matter collides with the surface of the guide inclination surface 135.

Large foreign matter tends to be held in the second guide flow path E2. This is because, as illustrated in FIGS. 11 and 6, the second guide flow path E2 is formed at a middle height of the air introduction part 123 close to the center thereof, and the inclination of the guide wall 121 is formed to be steep so that the large foreign matter is less likely to be held in the first guide flow path E1 located above the second guide flow path E2.

In some embodiments, the cleaning ring 130 may be coupled to the lower end of the guide wall 121 of the cleaning body 120. The cleaning ring 130 may be coupled to and may raise and lower with the coupling end part 122 located at the lower end of the guide wall 121. The cleaning ring 130 may function to compress dust and scrape off dust on the mesh net 35 while raising and lowering. The cleaning ring 130 may be made of an elastic material, for example, rubber or silicone, and may be transformed to some extent in the process of the compression such that the cleaning unit 110 may more efficiently raise and lower. The cleaning ring 130 being made of an elastic material may be advantageous in scraping off the dust on the outer surface of the mesh net 35.

The cleaning ring 130 may be approximately ring-shaped. In some embodiments, the cleaning ring 130 may be coupled to the coupling end part 122 of the guide wall 121 through double injection. The front surface 135 of the cleaning ring 130 coupled to the coupling end part 122 may face the inner surface 20 of the housing 1, and the rear surface 134 of the cleaning ring 130 may face the surface of the filtering unit 30 as the cleaning unit 110 is lowered. The front surface 135 of the cleaning ring 130 may be the guide inclination surface 135, so the same reference numeral is assigned thereto.

Figure 12:
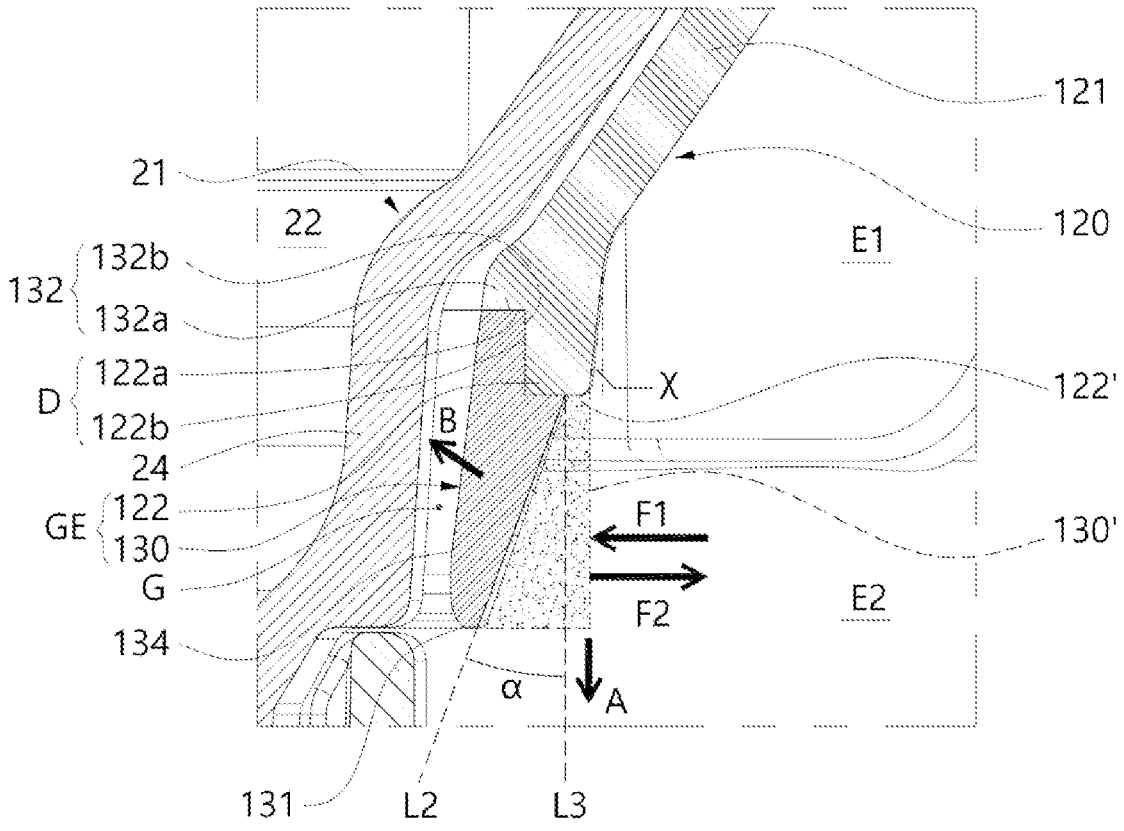
FIG. 12 is a sectional view illustrating an example configuration of a guide edge of the cleaning unit constituting the cleaner according to an embodiment of the present disclosure.

Referring to FIG. 12, the front surface 135 and the rear surface 134 of the cleaning ring 130 may be exposed, and only the upper surface 132 of the cleaning ring 130 may be coupled to the lower surface of the coupling end part 122. Accordingly, the cleaning ring 130 may be exposed except for the upper surface 132, and thus may be elastically transformed freely without being interfered with by the guide wall 121. For example, the cleaning ring 130 may be elastically transformed in a direction (as indicated by the direction of arrow B) of the combination end 24 of the air guide 21 located at the rear thereof, or may be elastically transformed in a direction opposite thereto. Transformation space G may be provided between the rear surface 134 of the cleaning ring 130 and the combination end 24 of the air guide 21.

In addition, the exposed area of the front surface 135 of the cleaning ring 130 may be sufficiently secured, and thus dust contained in the introduced air, particularly, large foreign matter, may have a high probability of colliding with the front surface 135 of the cleaning ring 130 instead of the outer surface of the guide wall 121. Furthermore, when the large foreign matter collides with the front surface 135 of the cleaning ring 130, the cleaning ring 130 may be elastically transformed, even by a small amount, in the direction of the transformation space G, so the width of the second guide flow path E2 may be increased.

As the coupling portion of the cleaning ring 130 and the guide wall 121 to each other is seen in FIG. 11, in the upper surface 132 of the cleaning ring 130, an upper coupling portion 132*a* and a first surface coupling portion 132*b* may be connected to each other so as to be orthogonal to each other. A lower coupling portion 122*a* and a second surface coupling portion 122*b* may be formed on the lower surface of the coupling end part 122 engaging with the upper coupling portion 132*a* and the first surface coupling portion 132*b*. The coupling portion of the cleaning ring 130 and the guide wall 121 to each other may approximately form an L-shaped section, thereby increasing a coupling area between the cleaning ring 130 and the guide wall 121.

Accordingly, the coupling force between the upper surface 132 of the cleaning ring 130 and the lower surface of the guide wall 121 engaged with each other may be weaker compared to the coupling force between the cleaning ring 130 and the guide wall 121 when the front surface 135 and the rear surface 134 of the cleaning ring 130 are engaged with the guide wall 121. However, in some embodiments, a support rib 126 may be provided in the guide wall 121 to compensate for this. Additional details regarding the support rib 126 are described below.

In FIG. 12, an angle formed by the guide inclination surface 135, which may be the front surface of the cleaning ring 130, is illustrated. As illustrated in FIG. 12, a predetermined angle $\alpha$ may be formed between the raising/lowering direction L3 of the cleaning unit 110 and the extending direction L2 of the guide inclination surface 135. Due to the angle, a portion of a reaction force to the collision of dust introduced in a horizontal direction with the guide inclination surface 135 may be dispersed downward.

Without the guide inclination surface 135, the shape of the cleaning ring 130 may have a shape represented as element 130' of FIG. 12. In this case, a force F1 applied to the cleaning ring 130 when dust collides therewith and a reaction force F2 thereto may be parallel to each other. Accordingly, large foreign matter may be easily held in the guide flow path E. That is, the reaction force F2 may not have a component force in the direction of the dust collection space S1 (in the direction of arrow A) or may be very small, so the large foreign matter may not be expected to be rotated in upright directions due to the guide inclination surface 135.

Figure 13:
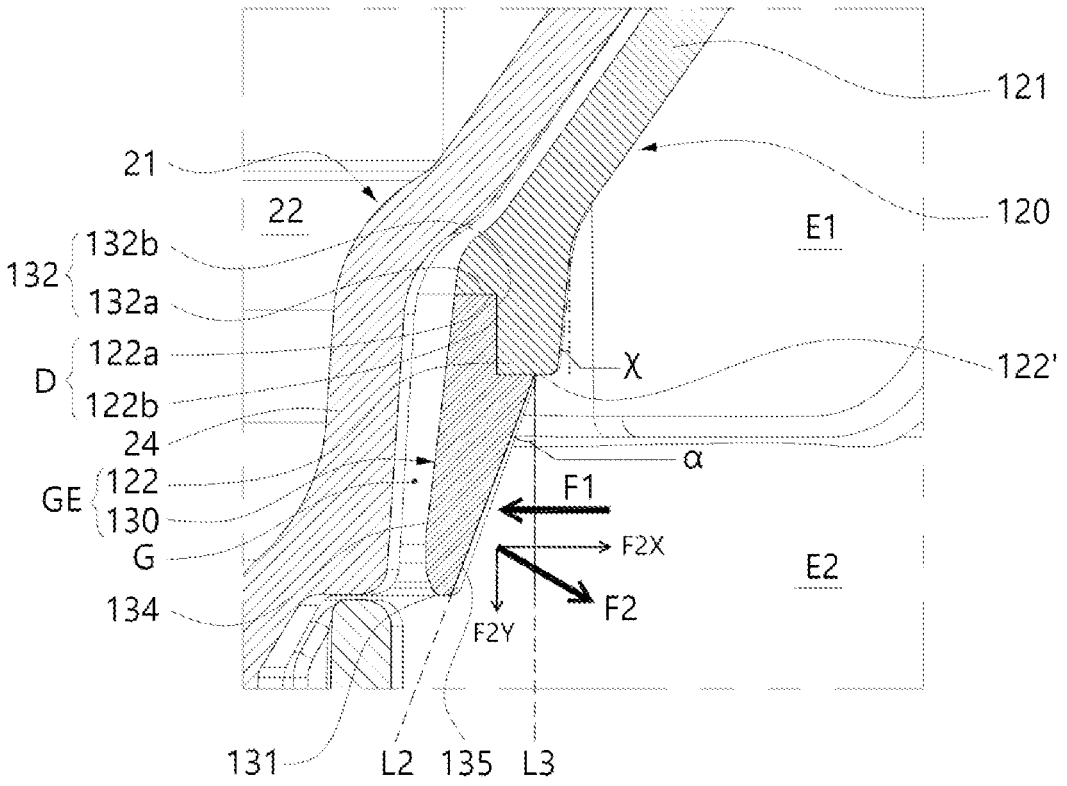
FIG. 13 is a sectional view illustrating a reaction force to an external force of foreign matter colliding with the guide edge of the cleaning unit constituting the cleaner according to an embodiment of the present disclosure.

Alternatively, referring to FIG. 13, the colliding force of large foreign matter may be expressed as F1, and a reaction force thereto may be expressed as F2 in a normal direction to the guide inclination surface 135 of the cleaning ring 130. The reaction force may be divided into a component force F2X in an X-axis direction (the direction of the inner surface 20 of the housing 1) and a component force F2Y in a Y-axis direction (the direction of the bottom portion of the dust collection space S1). As the inclination angle of the guide inclination surface 135 increases, the component force F2Y in the Y-axis direction may also increase. Preferably, the component force F2X in the X-axis direction may be three times or less than the component force F2Y in the Y-axis direction. In other words, the inclination angle of the guide inclination surface 135 may be greater than 20°.

Increasing the inclination angle of the guide inclination surface 135 may increase the component force F2Y in the Y-axis direction. However, when the inclination angle is beyond a predetermined range, the vertical width (a vertical height relative to the drawing) of the guide inclination surface 135 may decrease. This is because the combination end 24 of the air guide 21 is located at the rear of the cleaning ring 130 and the entirety of the cleaning ring 130 may slant toward the rear thereof. When the inclination angle of the guide inclination surface 135 is greater than 60°, the vertical width of the guide inclination surface 135 may decrease such that the guide inclination surface 135 may not provide a sufficient reaction area, and the cleaning of the outer surface of the mesh net 35 may also be difficult.

In some embodiments, the guide inclination surface 135 may be even with the surface of the coupling end part 122 of the guide wall 121. The coupling end part 122, together with the cleaning ring 130, may constitute the guide edge GE and form the guide inclination surface 135. In FIG. 13, the inclination angle of the guide inclination surface 135 of the coupling end part 122 is marked with x. The inclination angle x at which the guide inclination surface 135 of the coupling end part 122 defines may be formed to be smaller than the inclination angle α of the guide inclination surface 135 of the cleaning ring 130 such that the thickness of the coupling end part 122 is not excessively decreased. In some embodiments, the guide inclination surface 135 may be omitted in the coupling end part 122.

Figure 14A:
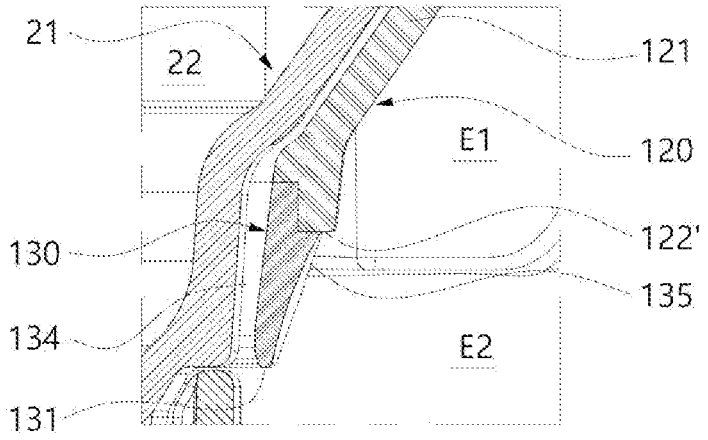
FIGS. 14A to 14C are sectional views illustrating different embodiments of the guide edge of the cleaning unit.
Figure 14B:
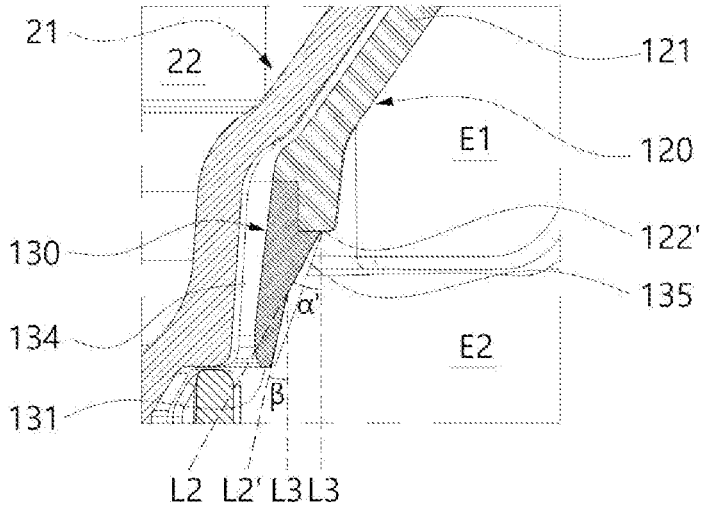
Figure 14C:
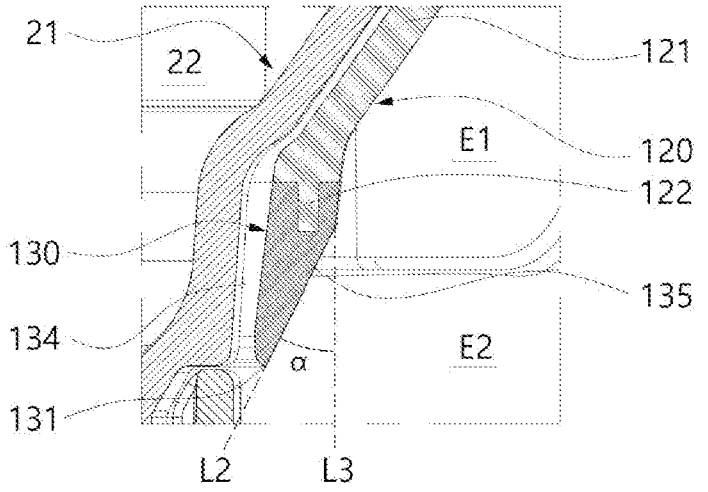

Different embodiments of the cleaning ring 130 are illustrated in FIGS. 14A, 14B, and 14C. First, referring to FIG. 14A, the guide inclination surface 135 located on the surface of the cleaning ring 130 may be formed as a curved surface. In other words, the guide inclination surface 135 may not necessarily be formed as a flat surface, but may be formed as a curved surface. A center portion of the guide inclination surface 135, as illustrated in FIG. 14A, may have a depressed shape, or conversely, the center portion thereof may have a protruding shape.

Referring to FIG. 14B, the guide inclination surface 135 located on the surface of the cleaning ring 130 may not have a predetermined angle, but may have multiple inclination angles. More precisely, a first inclination angle α which is an angle between an imaginary line L2 (which is located at an upper portion than an imaginary line L2' extending along the guide inclination surface 135) and a vertical extension line L3 may be larger than a second inclination angle β which is an angle between the imaginary line L2' (which is located at a lower portion than the imaginary line L2 extending along the guide inclination surface 135) and a vertical extension line L3'. The entire height of the cleaning ring 130 may be further increased by the structure of the cleaning ring 130 having such different angles to each other.

Referring to FIG. 14C, the coupling end part 122 of an inducing guide may be configured to be inserted to the upper portion of the cleaning ring 130. That is, a portion of the coupling end part 122 of the inducing guide may protrude in a direction of the cleaning ring 130, and the cleaning ring 130 may be configured to surround the portion of the coupling end part 122. In this case, the coupling area of the cleaning ring 130 and the inducing guide may be sufficiently wide so that the cleaning ring 130 and the inducing guide are more stably coupled to each other. Furthermore, the vertical width of the guide inclination surface 135 may also be increased, so an area of a reaction portion provided by the guide inclination surface 135, that is, an area of a portion of the guide inclination surface 135 with which dust collides may also be increased.

Referring back to FIG. 13, a step 122' may be provided in the coupling end part 122. The step 122' may be formed as a protrusion of coupling end part 122 from the cleaning ring 130 in the direction of the inner surface 20 of the housing 1. Due to this, the thickness of the coupling end part 122 may be described to be larger than the thickness of the cleaning ring 130. Due to such a step 122', the lower surface of the coupling end part 122 to which the cleaning ring 130 may be double injected and coupled may be wider so as to stabilize coupling of the cleaning ring 130 and the coupling end part 122 to each other and to facilitate the double injection operation of the cleaning ring may be facilitated.

Figure 15:
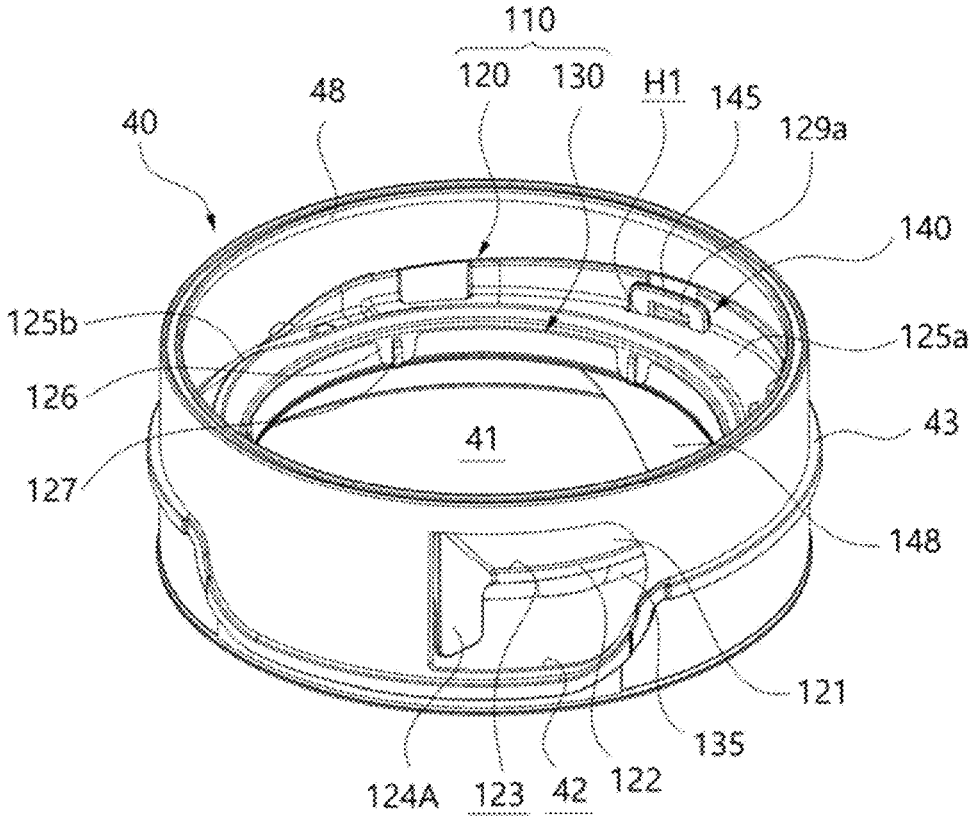
FIG. 15 is a perspective view illustrating an example configuration of the cleaning unit and an inner housing constituting the cleaner according to an embodiment of the present disclosure.
Figure 16:
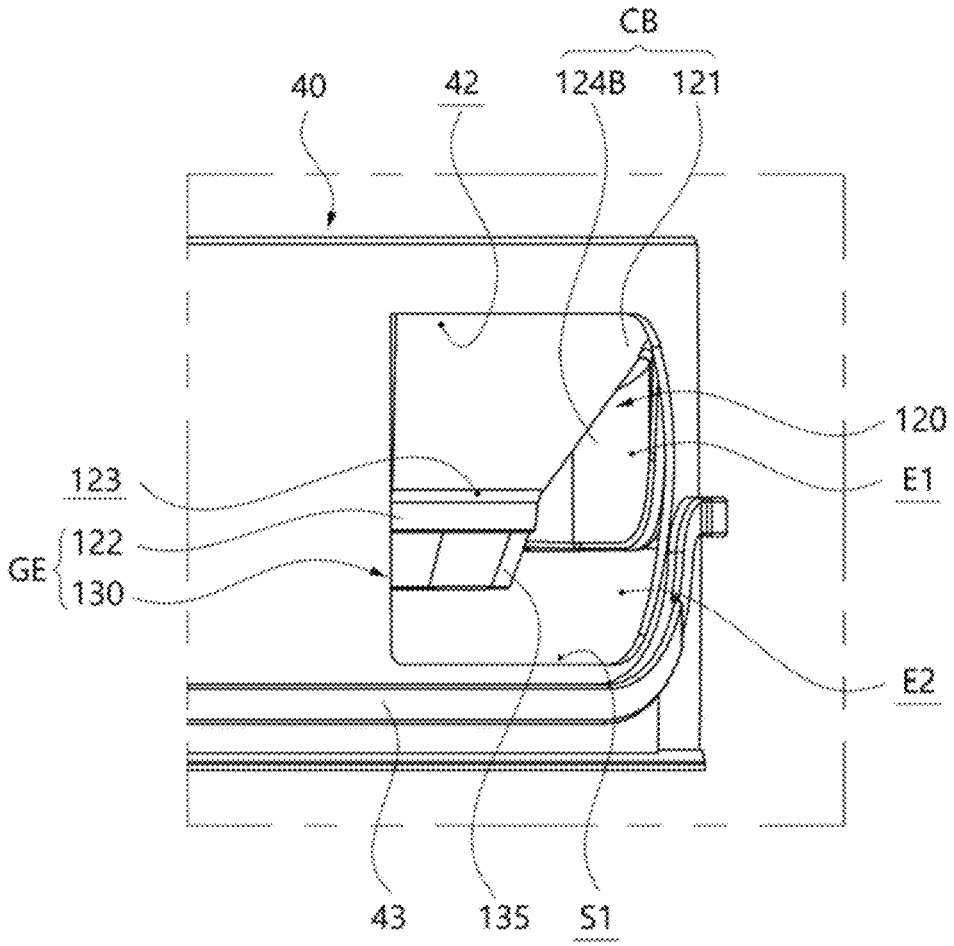
FIG. 16 is a front view of the air introduction part of the cleaning unit of FIG. 15 viewed through a communication window of the inner housing.

As shown in FIG. 15, the cleaning unit 110 may be assembled with the inner housing 40. A portion of the cleaning unit 110 may be connected to the introduction opening 8 through the communication window 42 formed in the inner housing 40. The air introduction part 123 of the cleaning unit 110 may be located at the inner side of the communication window 42, and a duct blade 124A may be in close contact with a side of the communication window 42. Accordingly, air introduced through the introduction opening 8 may naturally be guided to the air introduction part 123. Referring to FIG. 16, the upper portion of the guide wall 121 may block the upper portion of the cleaning body 120 relative thereto, so the introduced air may naturally flow downward.

That is, the air introduced through the air introduction part 123 may flow along the guide flow path E located between the guide wall 121 and the guide fence 124B constituting the cleaning body 120. In some embodiments, some of the introduced air may be introduced to the upper cleaning part 125. However, the air introduced to the upper surface of the cleaning body 120 may flow along the upper cleaning part 125 due to the structure of the upper cleaning part 125 described above, and then may be discharged in the direction of the dust collection space S1.

FIG. 17 shows the cleaning unit 110 and the inner housing 40 separated from each other and the reinforcement plate 140 separated from the cleaning body 120. The reinforcement plate 140 may be correspondingly coupled to the connecting plate 128 of the cleaning body 120 and may function to reinforce the connecting plate 128. The cleaning body 120, the cleaning ring 130, and the connecting plate 128 may form one cleaning unit 110.

As for the structure of the reinforcement plate 140, the reinforcement plate 140 may have a plate shape, and generally have a shape corresponding to the shape of the connecting plate 128. An assembly body 141 may be provided on the upper portion of the reinforcement plate 140, and a reinforcement body 148 may extend from the lower portion thereof. The reinforcement body 148 may be a structure having a width gradually decreasing toward the lower side thereof like the structure of the connecting plate 128. That is, the upper portion 148*a* of the reinforcement body 148 may be wider than the lower portion 148*b* thereof, so the reinforcement plate 140 may be a structure similar to the structure of the connecting plate 128.

As for the structure of the assembly body 141, the first assembly body 142 and the second assembly body 143 may be provided in the assembly body 141. The first assembly body 142 and the second assembly body 143 may be bent relative to each other. In some embodiments, the second assembly body 143 may protrude from the first assembly body 142 and may be bent therefrom. The first assembly body 142 and the second assembly body 143 may extend in an overall arc shape, and may be coupled to a section of the cleaning body 120.

Figure 24:
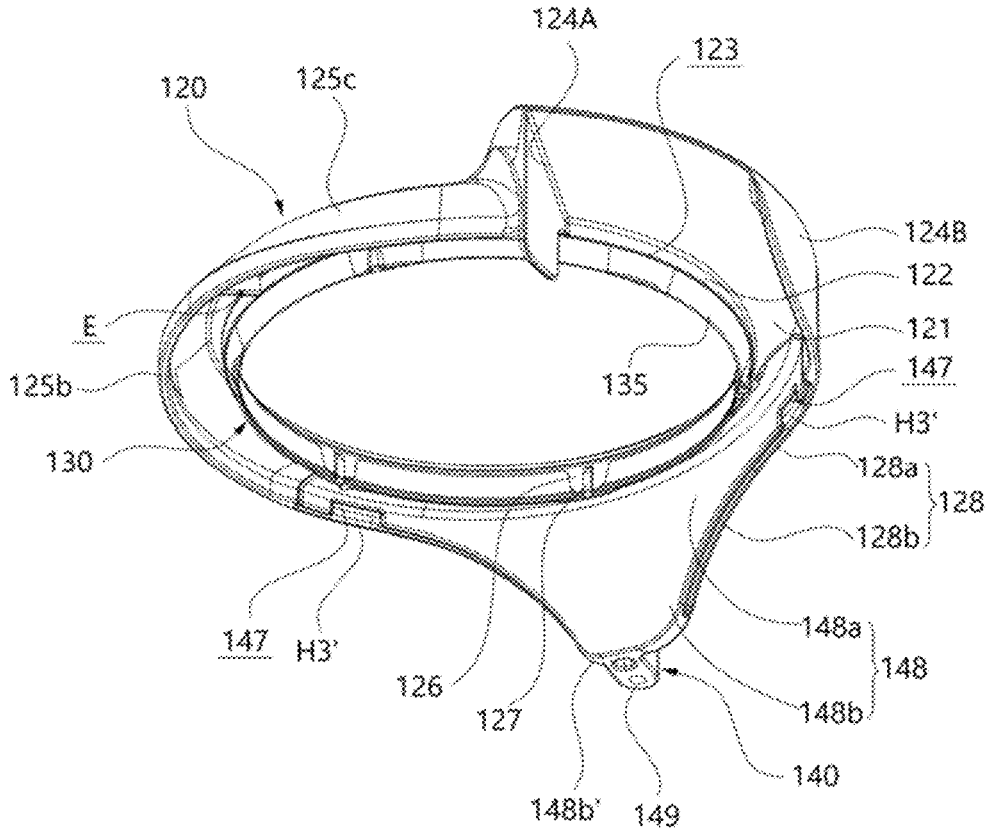
FIG. 24 is a perspective view illustrating the configuration of the cleaning unit constituting the cleaner according to the embodiment of the present disclosure viewed at an angle different from FIG. 23.

More precisely, the assembly body 141 may be inserted to and coupled to the guide flow path E formed between the guide wall 121 and the guide fence 124B of the cleaning body 120 to correspond to the guide flow path E. As illustrated in FIG. 24, the reinforcement plate 140 may be configured to constitute a portion of the guide flow path E. Accordingly, the reinforcement plate 140 may not prevent the flow of air.

As illustrated in FIG. 17, the assembly body 141 may have components therein to be assembled with the cleaning body 120, and may include a first assembly part 145, a second assembly part 146, and the third assembly part 147. These assembly parts may be held in corresponding assembly parts provided in the cleaning body 120 in the process in which the assembly parts are assembled with the cleaning body 120 so that the reinforcement plate 140 is fixed to the cleaning body 120. The detailed structure of the assembling is described further below.

The connection bracket 149 may be provided at a side of the reinforcement body 148 of the reinforcement plate 140. The connection bracket 149 may protrude from the lower portion of the reinforcement body 148 in the direction of the inner surface 20 of the housing 1. The connection bracket 149 may be connected to the lower end of the movable rail 175 of the manipulation unit 150 so that the movable rail 175 and the reinforcement plate 140 raise and lower together. Although not shown, the connection bracket 149 may be raised and lowered while being inserted to a raising/lowering channel provided in the inner surface 20 of the housing 1, and may be assembled with the movable rail 175 by a separate fastener such as a bolt.

Such a reinforcement plate 140 may be made of various materials. For example, the reinforcement plate 140 may be made of synthetic resin or metal. In some embodiments, the reinforcement plate 140 may be made of aluminum, and the cleaning body 120 may be made of synthetic resin.

Figure 19:
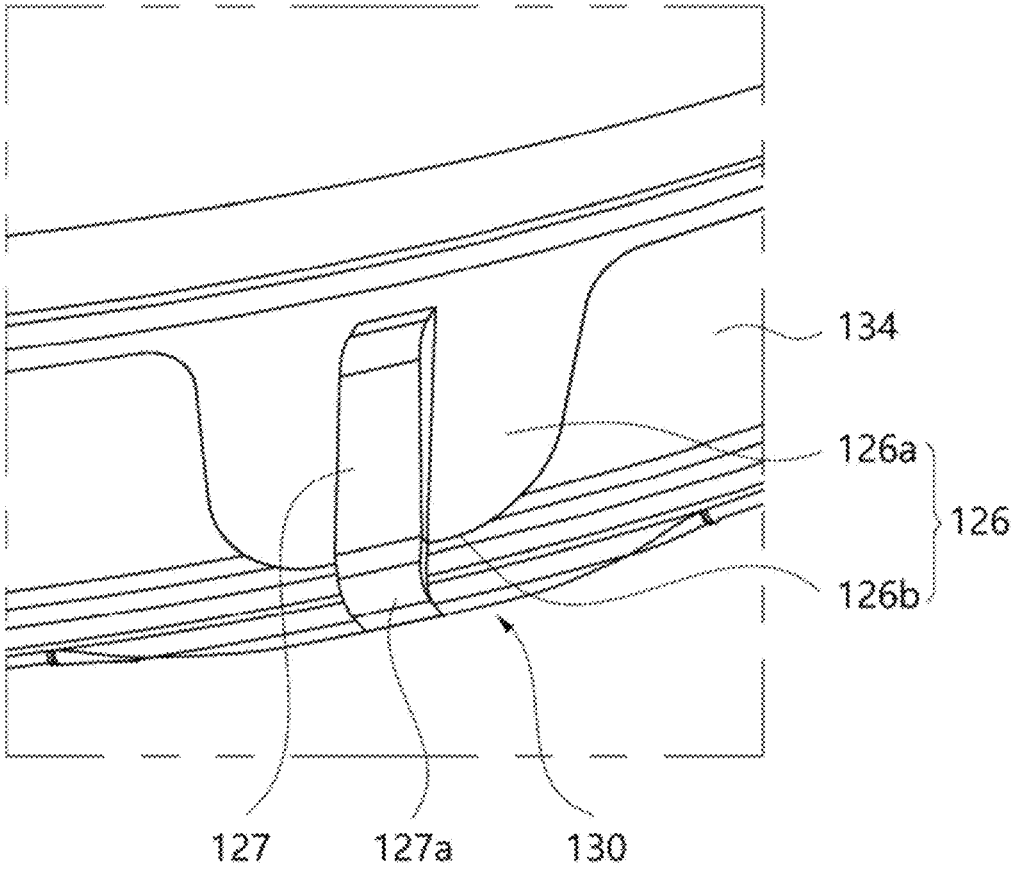
FIG. 19 is an enlarged perspective view of a support rib of the cleaning unit constituting the cleaner according to an embodiment of the present disclosure.
Figure 20:
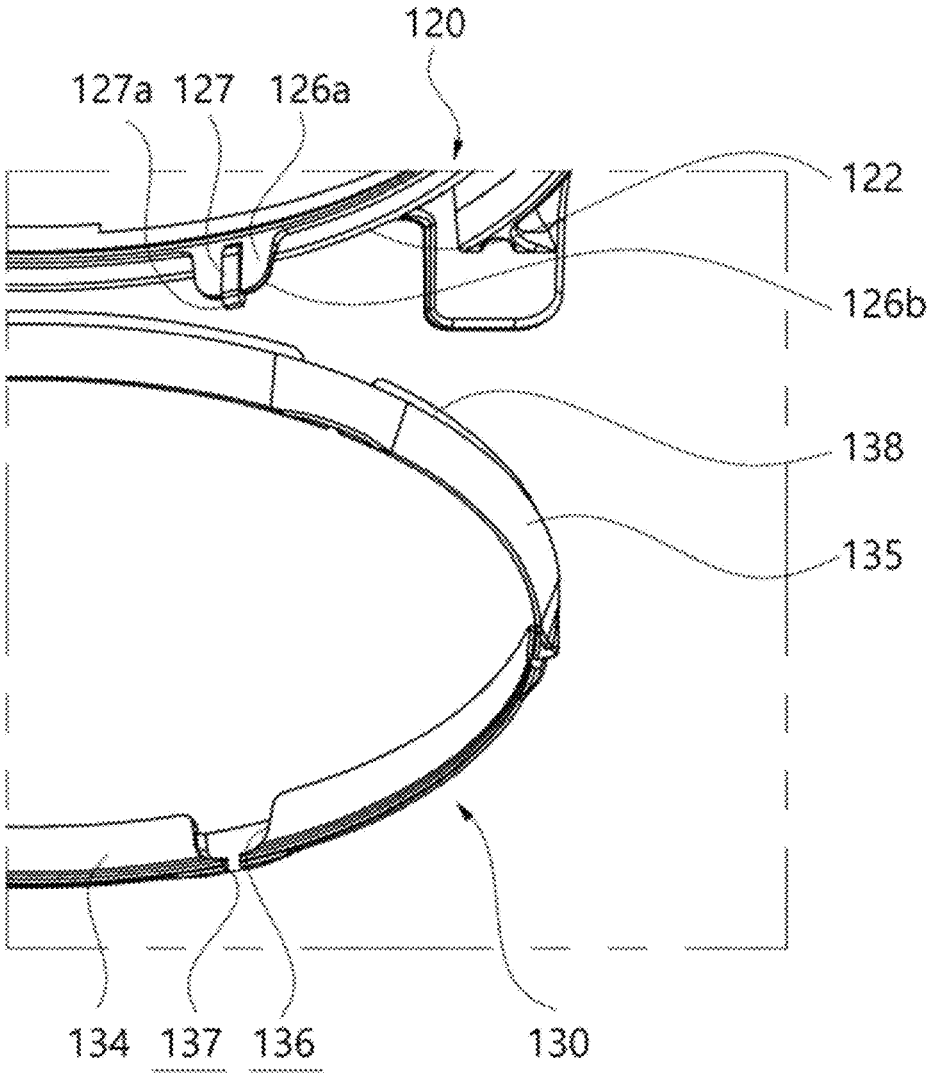
FIG. 20 is an exploded perspective view of the cleaning body and a cleaning ring of the cleaning unit constituting the cleaner according to an embodiment of the present disclosure'

Referring to FIGS. 19 and 20, the support rib 126 may be provided in the cleaning unit 110. The support rib 126 may protrude from the lower portion of the cleaning body 120. More precisely, the support rib 126 may protrude downward from the coupling end part 122 of the guide wall 121. The support rib 126 may protrude toward the bottom of the dust collection space S1, and may support the rear surface 134 of the cleaning ring 130 which is the opposite surface of the guide inclination surface 135 of the cleaning ring 130. That is, the support rib 126 may support a portion corresponding to the lower surface of the cleaning ring 130 at the rear thereof.

Multiple support ribs 126 may be provided on the circumference of the cleaning body 120, and at least a portion of each of the support ribs 126 may protrude up to or more than the lower end of the cleaning ring 130. Referring to FIG. 19, in some embodiments, the support rib 126 can be seen to protrude up to the lower end of the cleaning ring 130.

A support body 126*a*, which may have the shape of a thin plate and supporting the cleaning ring 130 may constitute the frame of the support rib 126, and a close-contact end 126*b* may be provided in a portion decreasing in width at the lower side of the support body 126*a*. Referring to FIG. 20, a seating groove 136 may be provided to have a concaved shape in the cleaning ring 130. An extension groove 137 may extend from the seating groove 136. The support body 126*a* and the close-contact end 126*b* of the support rib 126 may be located in the seating groove 136. Such a close-contact end 126*b* may increase the coupling area of the support rib 126 and the cleaning ring 130, and may decrease a portion of preventing the elastic transformation of the cleaning ring 130.

In some embodiments, the seating groove 136 may be omitted in the cleaning ring 130, and the support rib 126 may support the rear surface 134 of the cleaning ring 130. In this case, a portion of the cleaning ring 130 may protrude by the thickness of the support rib 126 by being pushed toward a front side thereof, that is, in the direction of the inner surface 20 of the housing 1. When the portion of the cleaning ring 130 protrudes in the direction of the inner surface 20 of the housing 1, air flow may be restricted, so the seating groove 136 may preferably be provided in the cleaning ring 130. In the state in which the support body 126*a* is inserted to the seating groove 136, the entire thickness of the cleaning ring 130 and the support body 126*a* may be the same as the thickness of the cleaning ring 130 in a portion not including the support rib 126. That is, the depth of the seating groove 136 may be the same as the thickness of the support body 126*a*. In some embodiments, the depth of the seating groove 136 may be larger than the thickness of the support body 126*a*. Such a seating groove 136 may be formed naturally during a double injection process for forming the cleaning ring 130 and the cleaning body 120.

The seating groove 136 may have an extension groove 137 extending further downward therefrom. The extension groove 137 may be completely open to the lower side of the cleaning ring 130. The gap maintenance rib 127 may be located at the extension groove 137. The gap maintenance rib 127 may protrude from the support rib 126. Referring to the enlarged portion of FIG. 22, the guide edge GE of the cleaning unit 110 and the surface of the filtering unit 30 may have space G defined therebetween by being spaced apart from each other. The gap maintenance rib 127 may protrude in the direction of narrowing the space G.

Figure 22:
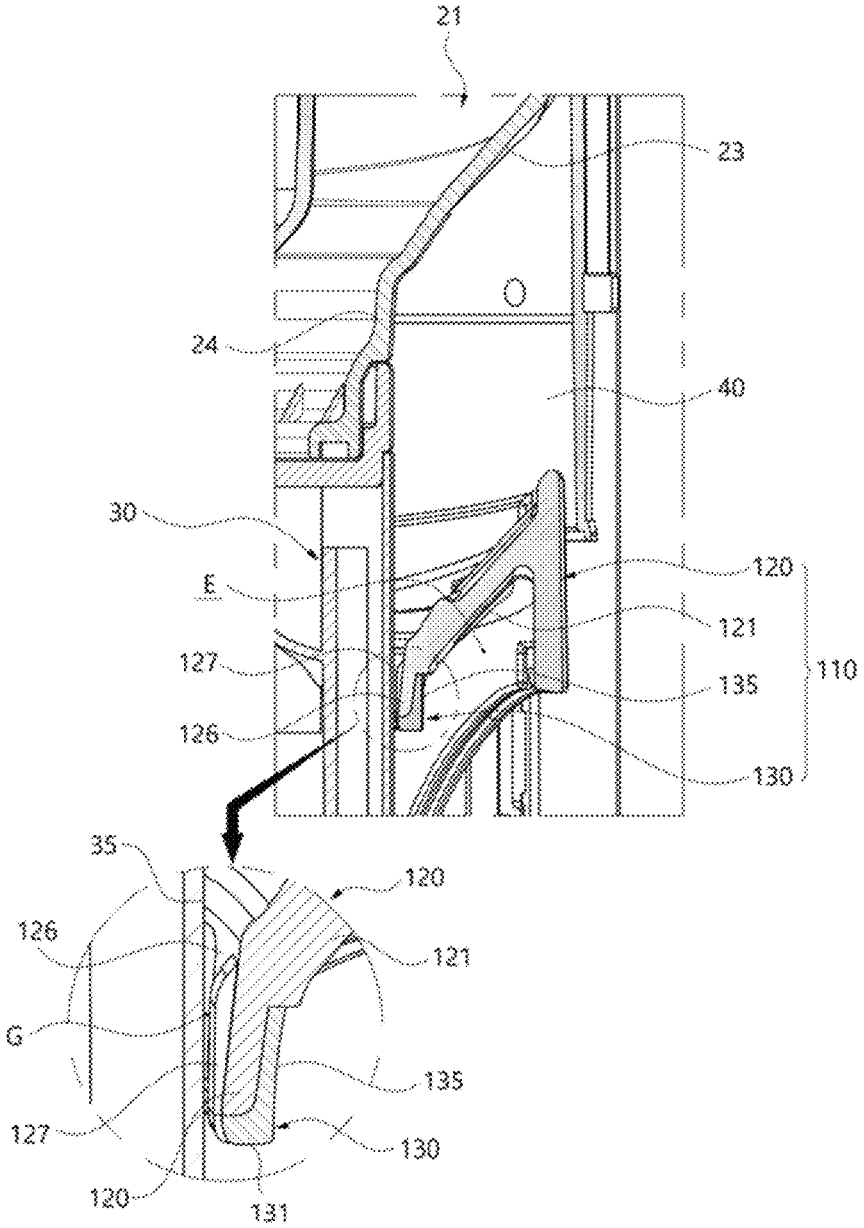
FIG. 22 is a sectional view illustrating the lowered state of the cleaning unit in FIG. 21.

The cleaning unit 110 may easily become eccentric while raising and lowering. When the cleaning unit 110 is off center, the cleaning unit 110 may be interfered with by the filtering unit 30 located at the center of cleaning unit and thus may be prevented from raising and lowering. To prevent the eccentricity, the gap maintenance rib 127 may maintain a gap between the cleaning unit 110 and the filtering unit 30. Referring to FIG. 22, the gap maintenance rib 127 may decrease the gap between the mesh net 35 of the filtering unit 30 and the cleaning ring 130 constituting the cleaning unit 110.

In some embodiments, the gap maintenance rib 127 may extend in the raising/lowering direction of the cleaning unit 110 such that the cleaning unit 110 may be prevented from becoming off-centered while raising and lowering. Without the gap maintenance rib 127, when the cleaning unit 110 is eccentric, the cleaning ring 130, which may be made of a flexible material) may be curled up or turned over while rubbing against the mesh net 35. The gap maintenance rib 127 may solve such a problem.

The degree of protrusion of the gap maintenance rib 127 from the support rib 126 may be different along the raising/lowering direction of the cleaning unit 110. As illustrated in the enlarged portion of FIG. 22, the gap maintenance rib 127 may protrude further at an upper side of the gap maintenance rib 127 than at a lower side. Due to such a structure, a gap between the gap maintenance rib 127 and the filtering unit 30 may be constant along the raising/lowering direction of the cleaning unit 110.

Figure 21:
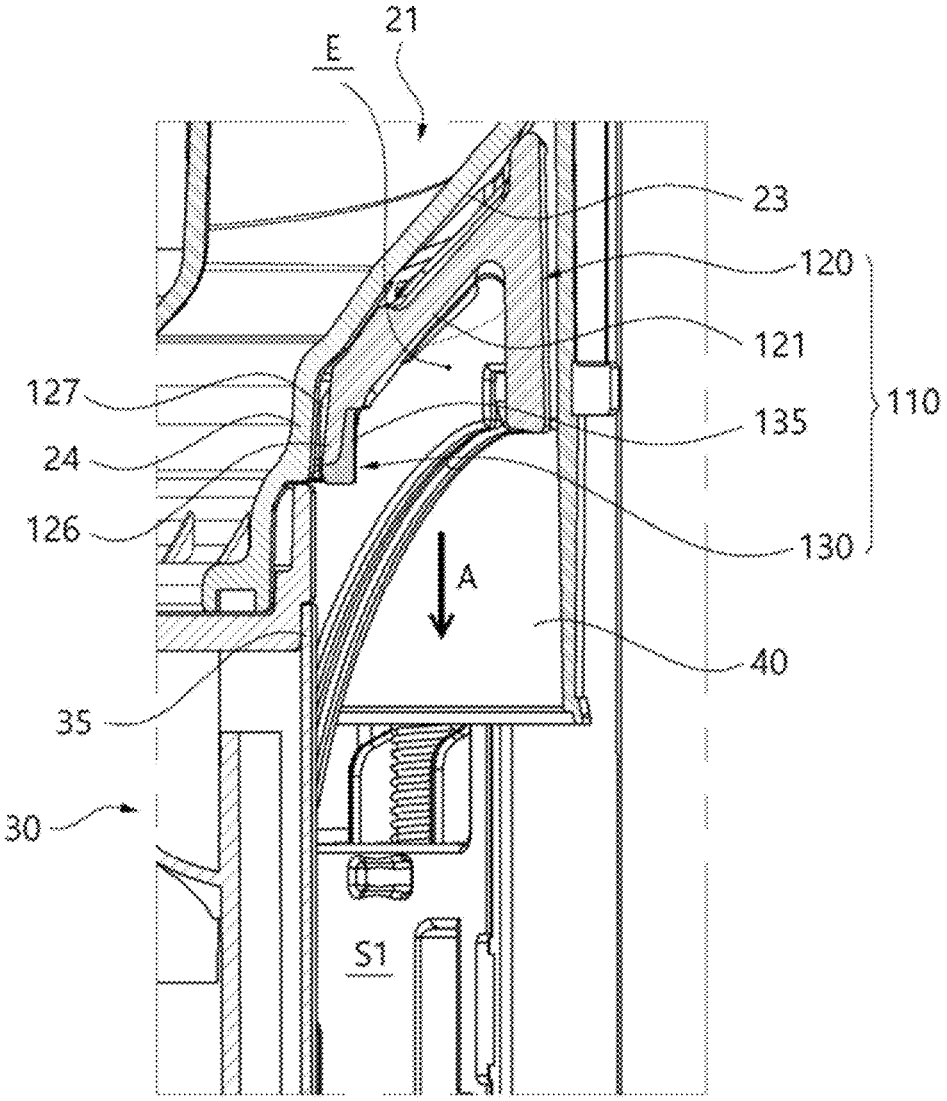
FIG. 21 is a sectional view taken along line IV-IV' of FIG. 1.

In FIG. 21, the cleaning unit 110 is located at the initial position, and in FIG. 22, the cleaning unit 110 is in the lowered state. As the cleaning unit 110 is lowered, the cleaning ring 130 may scrape the mesh net 35. In this case, the support rib 126 may support the rear of the cleaning ring 130 and prevent the cleaning ring 130 from being curled. The gap maintenance rib 127 may maintain a constant the gap between the cleaning unit 110 and the filtering unit 30, and may prevent the cleaning unit 110 from becoming off center. Alternatively, the gap maintenance rib 127 may be omitted, and the gap between the cleaning unit 110 and the filtering unit 30 may be reduced by using the thickness of the support rib 126.

For reference, in some embodiments, the cleaning ring 130 may be double injected and coupled to the cleaning body 120. In the process of the double injection, the cleaning ring 130 may be deformed due to high temperature, but the support rib 126 may prevent the deformation. Particularly, in some embodiments, the front surface and rear surface of the cleaning ring 130 may be exposed to the outside, and only the upper surface 132 of the cleaning ring 130 may be coupled to the lower surface of the coupling end part 122 (see FIG. 12). Accordingly, although the cleaning ring 130 may be easily deformed in the process of the double injection, the support rib 126 may prevent such a deformation of the cleaning ring 130. As described above, even in the process of the raising and lowering of the cleaning unit 110, the support rib 126 may prevent the cleaning ring 130 from being curled. Of course, the cleaning ring 130 may be attached to the cleaning body 120 by an adhesive or other attachment means, or may be assembled therewith in various ways such as a forcible fitting manner and a protrusion coupling manner.

Figure 23:
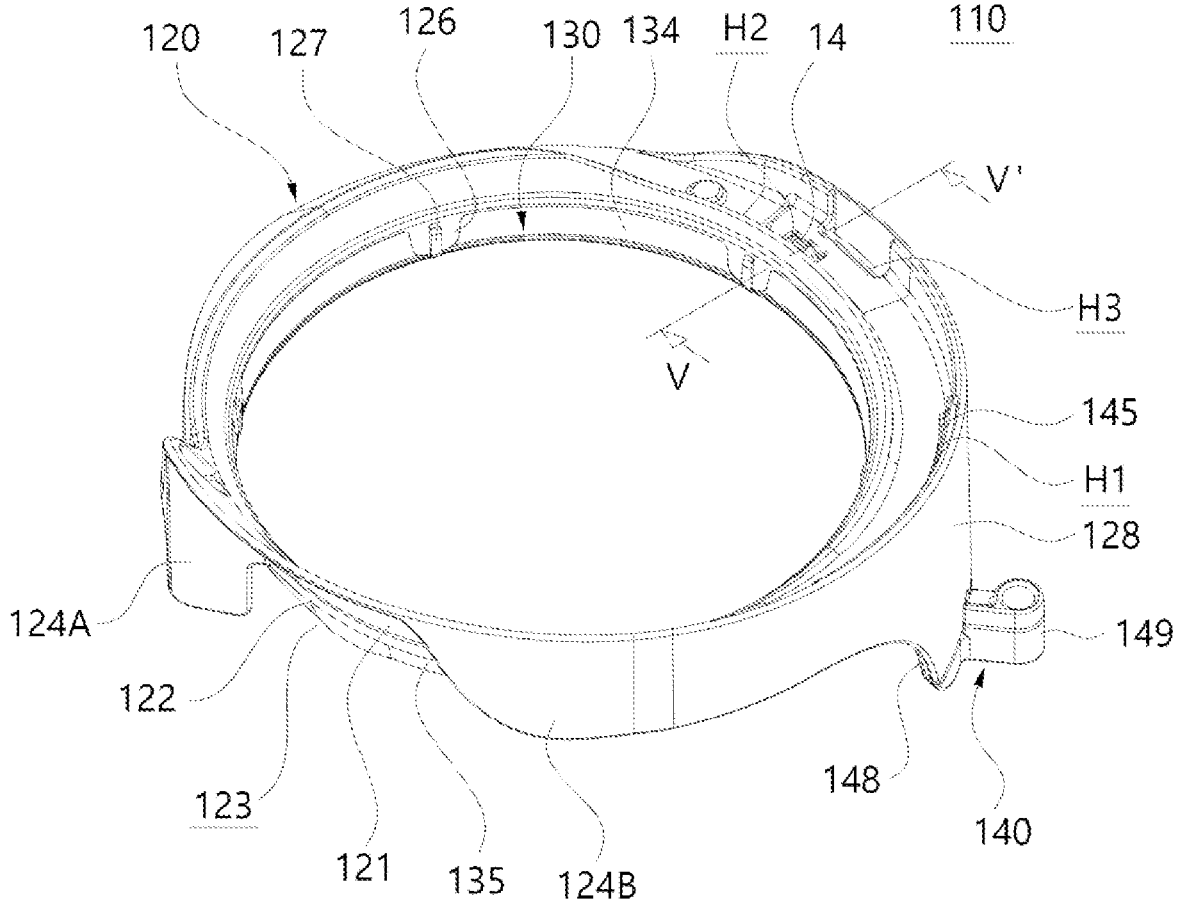
FIG. 23 is a perspective view illustrating an example configuration of the cleaning unit constituting the cleaner according to an embodiment of the present disclosure.

In FIG. 23, the structure of the cleaning unit 110 is illustrated, and the support rib 126 can be seen to be coupled to the cleaning ring 130. Multiple support ribs 126 may be provided along the circumference of the cleaning body 120. Each of the multiple support ribs 126 may be exposed toward the center portion (the filtering unit 30) of the cleaning body 120, but may not be exposed to the outer side (the inner surface 20 of the housing 1). This is because, in this embodiment, the support ribs 126 support only one surface of the cleaning ring 130. In other embodiments, the support ribs 126 may support the guide inclination surface 135 of the cleaning ring 130, but in this case, the support ribs 126 may block the guide inclination surface 135 and prevent the air flow.

The reinforcement plate 140 may be coupled to the cleaning body 120. Referring to FIG. 24, the reinforcement plate 140 can be seen to be coupled to the front of the connecting plate 128 connected to the lower portion of the cleaning body 120. The force of raising and lowering the cleaning unit 110 may be focused on the connection bracket 149 connected to the manipulation unit 150. The portion of the cleaning unit 110 protruding toward the introduction opening 8 may be relatively long compared to the connection bracket 149. Accordingly, a large load may be inevitably focused on the connection bracket 149 and the connection part (i.e. the connecting plate 128) may be easily warped. When the connecting plate 128 is warped, the cleaning unit 110 may be off center as a whole, and the efficient raising thereof may be prevented or restricted.

In some embodiments, the reinforcement plate 140 may be correspondingly coupled to the cleaning body 120 to increase the strength of the connection part. Accordingly, the reinforcement plate 140 may prevent the connection part from being warped or bent by an external force. As described above, the shape of the reinforcement body 148 of the reinforcement plate 140 may correspond to the shape of the connecting plate 128, so a contact area therebetween may be relatively large. As illustrated in FIG. 24, in some embodiments, the shape of the connecting plate 128 may be the same or approximately the same as the shape of the reinforcement body 148 of the reinforcement plate 140. Alternatively, the reinforcement body 148 may be coupled to only a portion of the connecting plate 128.

Referring to FIGS. 23 and 24, multiple holes may be provided in the cleaning body 120. The holes may be formed in the raising/lowering direction of the cleaning unit 110. In some embodiments, a first assembly hole H1, a second assembly hole H2, and a third assembly hole H3 may be provided in the cleaning body 120. The first assembly part 145 in the assembly body 141 of the reinforcement plate 140 may be assembled with the first assembly hole H1; the second assembly part 146 may be assembled with the second assembly hole H2; and the third assembly part 147 may be assembled with the third assembly hole H3.

Figure 25:
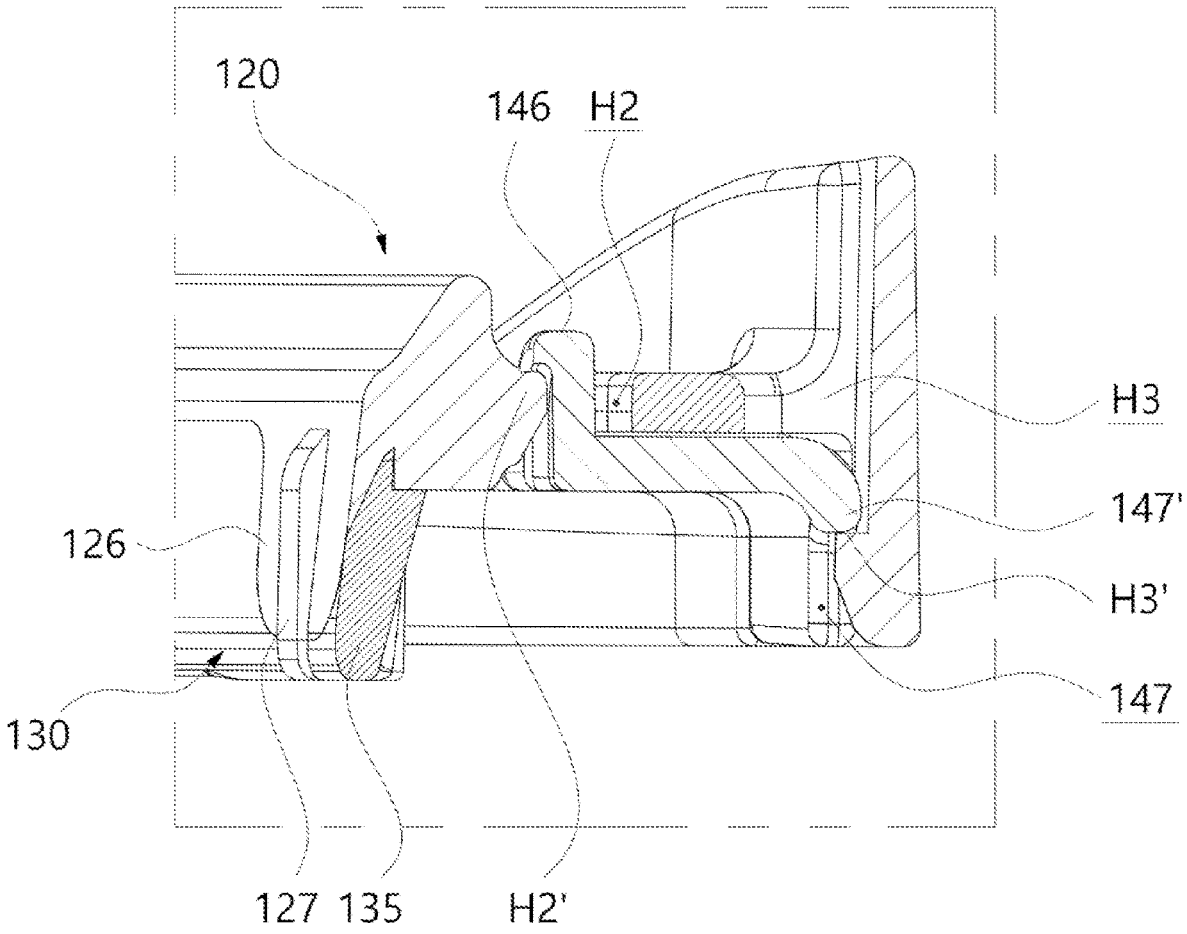
FIG. 25 is a sectional view taken along line V-V' of FIG. 23.

The first assembly part 145 may be inserted into and hooked to the first assembly hole H1. Referring to FIG. 25 which is a sectional view taken along line V-V' of FIG. 23, the end of the second assembly part 146 inserted to the second assembly hole H2 may be held in and assembled with an assembly end H2' located at the edge of the second assembly hole H2. The third assembly part 147 inserted to the third assembly hole H3 may form an empty space (see FIG. 24), but an assembly end part 147' may be provided at the inner side thereof. Accordingly, the assembly end part 147' may be held in and assembled with a seating end H3' located at the edge of the entrance of the third assembly hole H3. This assembly structure is provided by way of example, and the reinforcement plate 140 may be assembled with the connecting plate 128 in various other configurations. For example, the reinforcement plate 140 may be assembled to the cleaning body 120 by an insert injection method, or by using a separate fastener, or any other suitable means.

As described above, just because all the components constituting of the cleaner according to the embodiment of the present disclosure have been described as being combined into one or operating in the combination, the present disclosure is not necessarily limited to such embodiments. That is, if it is within the scope of the purpose of the present disclosure, all the components may be selectively combined into more than one and operated. In addition, terms such as "include," "constitute," or "have" described above, unless otherwise stated, mean that the corresponding component may be present. Accordingly, it should be construed that other components are not excluded, but may be included. All terms, including technical or scientific terms, have the same meaning as commonly understood by those skilled in the technical field to which the present disclosure belongs, unless defined otherwise. Commonly used terms, such as terms defined in the dictionary, should be interpreted as being consistent with the context of the relevant technology, and in the present disclosure, unless explicitly defined, should not be interpreted as having an ideal or excessively formal meaning.

Although the description of the present disclosure has been described for illustrative purposes, those skilled in the art will appreciate that various modifications, additions and substitutions are possible, without departing from the scope and spirit of the present disclosure as disclosed in the accompanying claims. Accordingly, the embodiments disclosed in the present disclosure are not intended to limit, but to explain the technical idea of the present disclosure, and the scope of the technical idea of the present disclosure is not limited by the embodiments. The scope of protection of the present disclosure should be interpreted by the scope of the claims below, and all technical ideas within the scope equivalent thereto should be construed as being included in the scope of the claims of the present disclosure.

What is claimed is:

1. A cleaner comprising:

a housing having an introduction opening through which air is introduced;

a filtering unit configured to be mounted in an inner space of the housing, and defining a dust collection space between the filtering unit and an inner surface of the housing;

a cleaning unit configured to surround the filtering unit, and configured to be raised and lowered inside the dust collection space, wherein, when the cleaning unit is in an initial position, at least a portion of the cleaning unit is connected to an air introduction path extending from the introduction opening to guide a flow of introduced air; and a guide edge extending from a lower portion of a cleaning body constituting the cleaning unit toward a bottom of the dust collection space, the guide edge comprising:

a surface facing the inner surface of the housing and being inclined to gradually increase a gap between the surface of the guide edge and the inner surface of the housing; and a cleaning ring of an elastic material coupled to a lower end of the cleaning body and protruding to the bottom of the dust collection space, wherein a gap between a guide inclination surface of the guide edge and the inner surface of the housing at the same height gradually increases in a direction toward the bottom of the dust collection space, wherein at least a part of the guide inclination surface is formed on a surface of the cleaning ring, wherein the cleaning body comprises a guide wall disposed along a circumferential direction of the cleaning body, wherein the cleaning ring is coupled to a lower portion of the cleaning body along a lower end of the guide wall, wherein the cleaning body comprises a coupling end part coupled to the cleaning ring provided on the lower end of the guide wall, and wherein the coupling end part is thicker than the guide wall, and a step surface is formed on a lower surface of the coupling end part coupled to the cleaning ring.

2. The cleaner of claim 1, wherein the cleaning unit comprises:

the cleaning body configured to surround the filtering unit and being connected to a manipulation unit to operate in cooperation with the manipulation unit; and the guide edge, wherein the guide inclination surface is provided on the surface of the guide edge facing the inner surface of the housing.

3. The cleaner of claim 1, wherein the guide wall is inclined relative to a raising and lowering direction of the cleaning unit such that when the cleaning unit is located at the initial position, the cleaning unit guides a flow of the air introduced through the introduction opening.

4. The cleaner of claim 3, wherein:

the guide wall is inclined such that a gap between the guide wall and the inner surface of the housing increases toward a lower portion of the guide wall that is directed toward the guide edge; and the coupling end part and the cleaning ring form the guide edge.

5. The cleaner of claim 3, wherein:

the lower surface of the coupling end part disposed on the lower end of the guide wall is coupled to an upper surface of the cleaning ring;

a front surface of the cleaning ring faces the inner surface of the housing; and a rear surface of the cleaning ring faces a surface of the filtering unit at a lowered position of the cleaning unit.

6. The cleaner of claim 1, wherein the cleaning body is configured to surround the filtering unit, and being connected to a manipulation unit to operate in cooperation with the manipulation unit, the cleaning body comprising:

the guide wall extending continuously in the circumferential direction of the cleaning body, the guide wall comprising an inclining surface and the guide edge on a lower portion of the guide wall;

a guide fence extending parallel to the guide wall and being spaced apart from the guide wall in a direction of the inner surface of the housing to form a guide flow path between the guide fence and the guide wall; and an air introduction part disposed in a portion of the cleaning body connected to the introduction opening, the air introduction part communicating the guide flow path with the introduction opening.

7. The cleaner of claim 1, wherein the cleaning body includes a guide flow path defining a cross-sectional area formed by the guide wall and a guide fence that decreases along the guide flow path, and a height that gradually decreases toward an exit of the guide flow path.

8. The cleaner of claim 1, further comprising:

an air introduction part disposed in the cleaning unit to connect a guide flow path with the introduction opening, the introduction opening being formed in an introduction housing connected to the housing;

a duct blade disposed at a first side of the air introduction part to block the first side of the air introduction part such that the guide flow path is formed in one direction relative to the duct blade;

a guide blade disposed in the introduction housing and configured to block a side of an introduction flow, wherein the duct blade and the guide blade are arranged continuously along an imaginary extension line.

9. The cleaner of claim 1, further comprising an upper cleaning part disposed on an upper surface of the cleaning unit corresponding to an opposite side of a guide flow path and forming a continuous path along the circumferential direction, wherein an entrance of the upper cleaning part starting at a position adjacent to the introduction opening is formed at a location higher than an exit of the upper cleaning part, the exit of the upper cleaning part extending up to a duct blade provided at one side of an air introduction part of the cleaning body.

10. The cleaner of claim 1, further comprising a support rib protruding from a lower portion of the cleaning body toward the bottom of the dust collection space, the support rib being configured to support an opposite surface of the guide inclination surface of the cleaning ring coupled to the lower portion of the cleaning body, at least a portion of the support rib having a length greater than or equal to a length of a lower end of the cleaning ring.

11. The cleaner of claim 10, further comprising a seating groove disposed in the cleaning ring and configured to receive the support rib, the seating groove having a depth greater than or equal to a thickness of the support rib.

12. The cleaner of claim 10, further comprising a gap maintenance rib protruding from the support rib in a direction opposite the guide inclination surface, the gap maintenance rib being configured to maintain a gap between a surface of the filtering unit and the cleaning ring while the cleaning unit is raised and lowered.

13. The cleaner of claim 1, wherein an angle between a raising/lowering direction of the cleaning unit and an imaginary extension line extending along a guide inclination surface of the guide edge is within 20° to 60°.

14. The cleaner of claim 1, further comprising:

a connecting plate extending from the cleaning body of the cleaning unit along a raising and lowering direction of the cleaning unit, the connecting plate comprising a plate facing the inner surface of the housing and a portion that gradually narrows in a direction away from the cleaning body;

a manipulation unit configured to raise and lower the cleaning unit and being connected to the connecting plate such that the manipulation unit and the cleaning unit operate in cooperation with each other; and a connection bracket disposed on the connecting plate at the portion of the connecting plate that gradually narrows and connecting to the manipulation unit.

15. The cleaner of claim 1, further comprising:

a connecting plate extending from the cleaning body of the cleaning unit along a raising and lowering direction of the cleaning unit; and a reinforcement plate coupled to the connecting plate; and connection bracket disposed on the reinforcement plate to connect the reinforcement plate to a manipulation unit.

16. The cleaner of claim 15, wherein the reinforcement plate comprises:

an assembly body inserted between the guide wall and a guide fence and coupled to the cleaning body, the assembly body extending in an arc shape; and a reinforcement body extending from the assembly body, the reinforcement body being coupled to the connecting plate and the manipulation unit.

17. A cleaner comprising:

a housing having an introduction opening through which air is introduced;

a first cyclone part configured to be mounted to the housing to separate dust from the air introduced through the introduction opening;

a second cyclone part configured to be mounted in an inner space of the housing, and defining a dust collection space between the second cyclone part and an inner surface of the housing;

a cleaning unit configured to surround the second cyclone part, and configured to be raised and lowered inside the dust collection space, wherein, when the cleaning unit is in an initial position, at least a portion of the cleaning unit is connected to an air introduction path extending from the introduction opening to guide a flow of introduced air;

a manipulation unit connected to the cleaning unit to raise and lower the cleaning unit, and protruding to an outside of the housing; and a cleaning ring disposed on a lower end of a cleaning body constituting the cleaning unit and protruding to a bottom of the dust collection space, the cleaning ring being formed of an elastic material and being slanted to extend toward a surface of the second cyclone part to form a guide inclination surface on a surface of the cleaning ring toward an inner surface of the housing, wherein the cleaning body comprises a guide wall disposed along a circumferential direction of the cleaning body, wherein the cleaning ring is coupled to a lower portion of the cleaning body along a lower end of the guide wall, wherein the cleaning body comprises a coupling end part coupled to the cleaning ring provided on the lower end of the guide wall, and wherein the coupling end part is thicker than the guide wall, and a step surface is formed on a lower surface of the coupling end part coupled to the cleaning ring.

18. A cleaner comprising:

a housing having an introduction opening through which air is introduced;

a first cyclone part configured to be mounted to the housing and to separate dust from the air introduced through the introduction opening;

a second cyclone part configured to be mounted in an inner space of the housing and defining a dust collection space between the second cyclone part and an inner surface of the housing;

a cleaning unit configured to surround the second cyclone part, and configured to be raised and lowered inside the dust collection space, wherein, when the cleaning unit is in an initial position, at least a portion of the cleaning unit is connected to an air introduction path extending from the introduction opening to guide a flow of introduced air;

a manipulation unit connected to the cleaning unit to raise and lower the cleaning unit, and protruding to an outside of the housing; and a cleaning ring disposed on a lower portion of a cleaning body constituting the cleaning unit, the cleaning ring being formed of an elastic material and gradually decreasing in diameter in a direction toward an end portion directed toward a bottom of the dust collection space to form a surface that is inclined toward the inner surface of the housing, wherein the cleaning body comprises a guide wall disposed along a circumferential direction of the cleaning body, wherein the cleaning ring is coupled to a lower portion of the cleaning body along a lower end of the guide wall, wherein the cleaning body comprises a coupling end part coupled to the cleaning ring provided on the lower end of the guide wall, and wherein the coupling end part is thicker than the guide wall, and a step surface is formed on a lower surface of the coupling end part coupled to the cleaning ring.

* * * * *